US005177913A

United States Patent [19]

Erel

[11] Patent Number: 5,177,913

[45] Date of Patent: Jan. 12, 1993

[54] PRE-FABRICATED MODULAR PARKING LOT

[76] Inventor: Yigal Erel, 59 Shearit Hapleta Street, Haifa, Israel

[21] Appl. No.: 587,933

[22] Filed: Sep. 25, 1990

[30] Foreign Application Priority Data

Oct. 12, 1989 [IL] Israel ..... 91978

[51] Int. Cl.[5] ..... E04H 1/00

[52] U.S. Cl. ..... 52/79.1; 52/236.7; 52/175

[58] Field of Search ..... 52/175, 176, 79.1, 79.2, 52/236.2, 236.8, 236.7, 236.9

[56] References Cited

U.S. PATENT DOCUMENTS

| | | | |
|---|---|---|---|
| 1,886,944 | 11/1932 | D'Humy | 52/176 |
| 3,510,997 | 5/1970 | Ratych | 52/79.2 |
| 3,566,558 | 3/1971 | Fisher | 52/236.9 X |
| 3,653,146 | 4/1972 | Goldfarb | 52/175 X |
| 3,805,461 | 4/1974 | Jagoda | 52/79.2 X |
| 3,813,835 | 6/1974 | Rice | 52/79.2 X |
| 4,060,948 | 12/1977 | Brownlee | 52/236.8 |
| 4,068,425 | 1/1978 | Czorniak | 52/236.8 X |
| 4,211,043 | 7/1980 | Coday | 52/79.1 |
| 4,263,757 | 4/1981 | Thys | 52/79.1 |
| 4,800,694 | 1/1989 | Sasaki | 52/175 |

FOREIGN PATENT DOCUMENTS

| | | | |
|---|---|---|---|
| 0118723 | 9/1984 | European Pat. Off. | 52/175 |
| 654479 | 1/1963 | Italy | 52/176 |
| 1507934 | 9/1989 | U.S.S.R. | 52/79.1 |

*Primary Examiner*—Richard E. Chilcot, Jr.
*Assistant Examiner*—Lan Mai
*Attorney, Agent, or Firm*—Lowe, Price, LeBlanc & Becker

[57] ABSTRACT

A multi-level parking lot made from prefabricated reinforced concrete modular elements is disclosed. The modular elements include plural parking compartments with defined paths for passage between the compartments and approach routes for entering the parking lot. The parking compartments include connecting plates and integral units with four columns, each integral unit including a slab integral with and resting on the four columns. A steel pipe protrudes from an upper surface of the column for interfitting engagement with a corresponding hole in the connecting plate. The individual units bear against themselves in a stable manner by virtue of their weight without the need for any linking connections therebetween.

9 Claims, 19 Drawing Sheets

FIG. 14
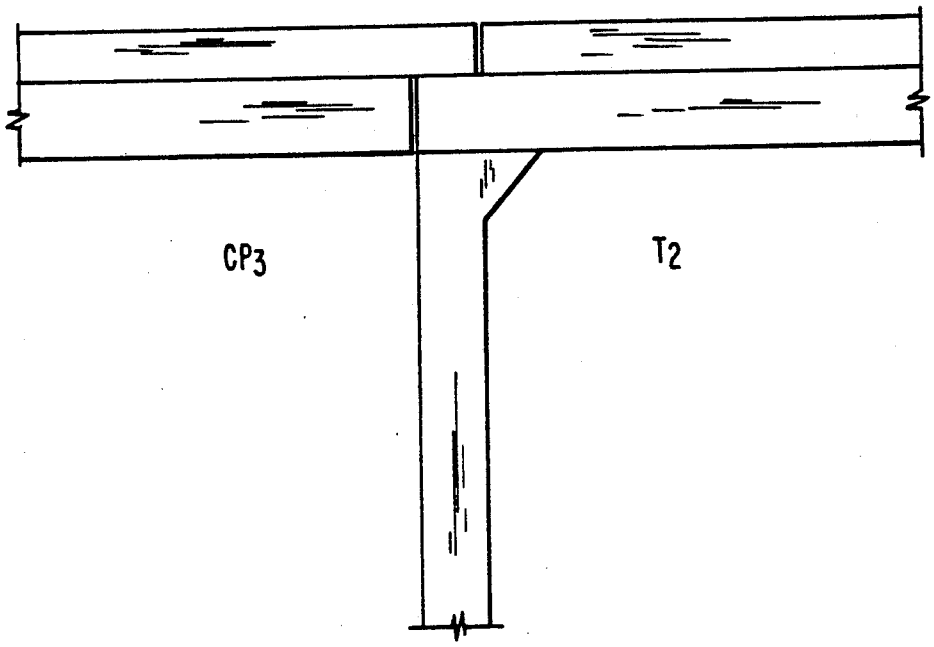
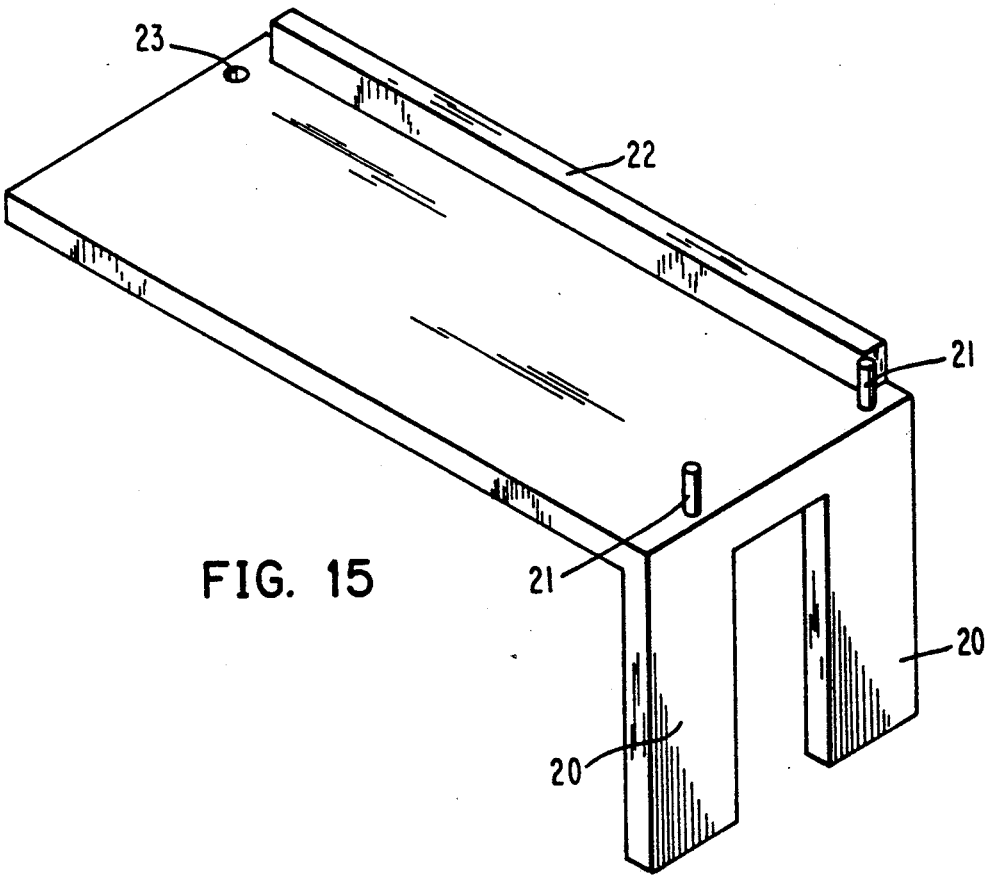
FIG. 15

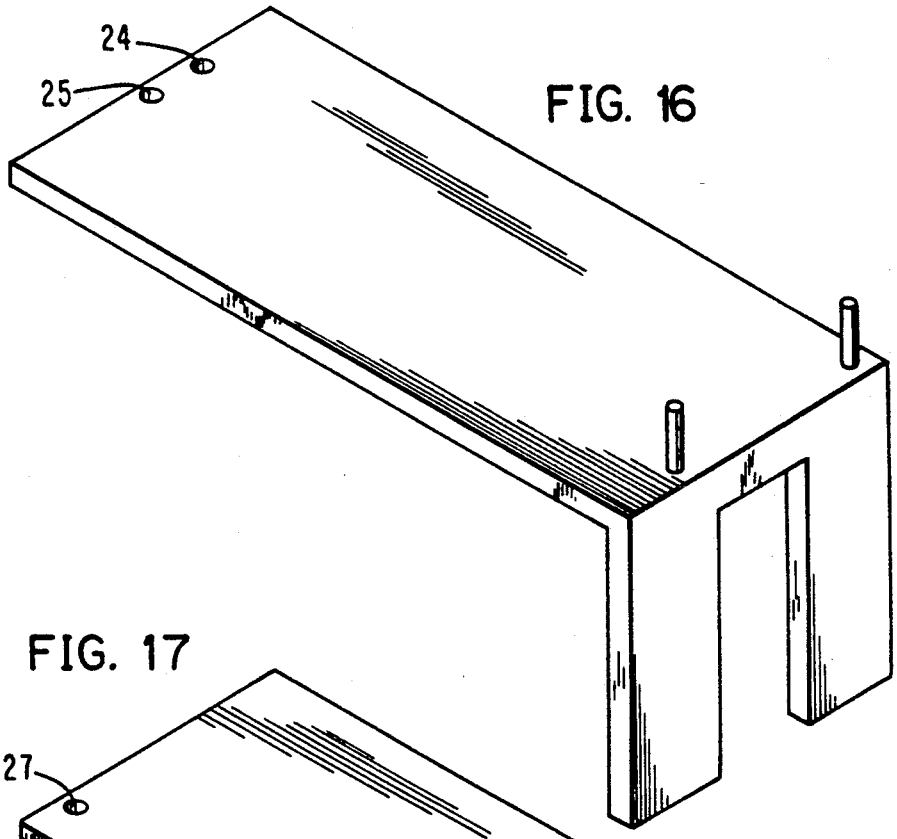
FIG. 16
FIG. 17
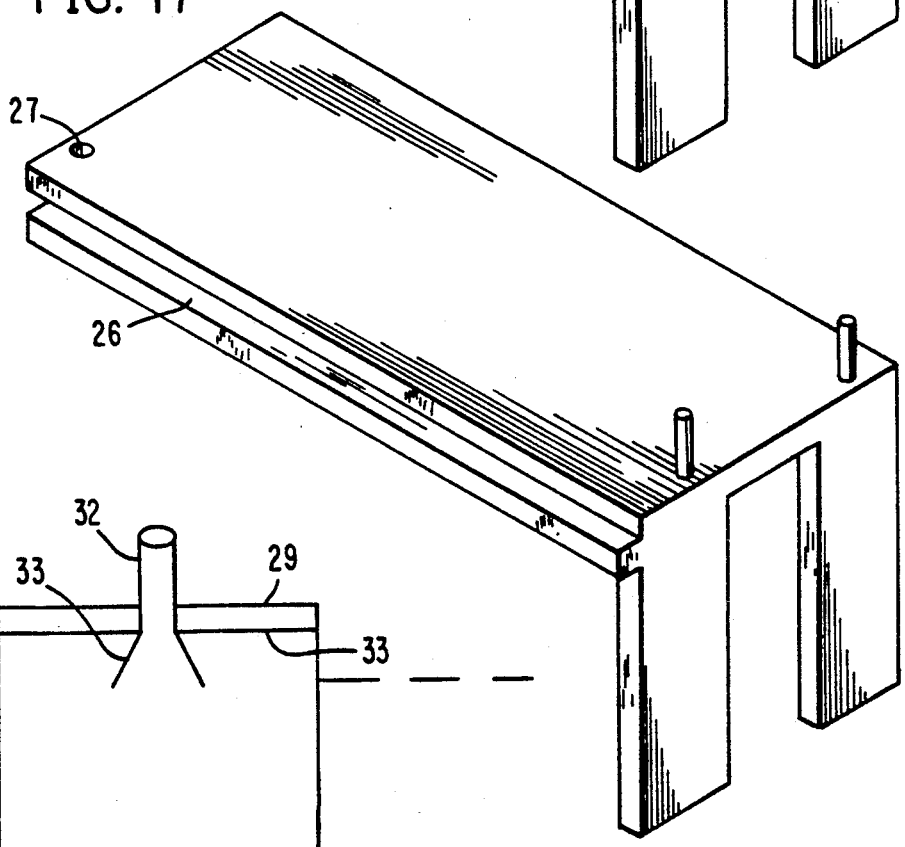
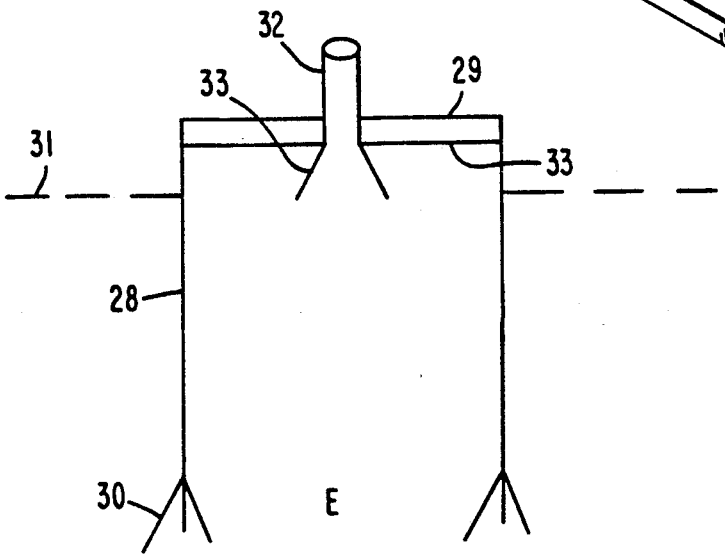
FIG. 18

PRE-FABRICATED MODULAR PARKING LOT

FIELD OF THE INVENTION

The present invention relates to a modular prefabricated parking lot which can be quickly constructed and dissembled. The invention also relates to the individual pre-fabricated parts comprising this parking lot and to a method for combining them.

BACKGROUND OF THE INVENTION

In large urban areas, and especially in city centers all over the world there is a shrtage of parking places. There are big cities where the shortage of parking places is so acute that the center of town is closed to private vehicles during certain hours of the day. Every year the number of motor vehicles on the roads in the cities increases. The increasing shortage of parking places implies waste of precious working time with people driving around looking for a place to park the car.

This acute shortage of parking places, especially in the city centers of towns is one of the reasons for the traffic jams there and often even prevents many people from going into the city center. Lack of parking places brings about the decline of these city centers due to the fact that the economic, commercial and social development of a city requires the simultaneous development of parking places.

The addition of parking places in the city center and in other essential places such as airports, main railroad stations, inter-city buses etc. is of the utmost significance in the development of a city and the maximum exploitation of its center as an essential aspect of economic growth.

The main purpose of the present invention is to increase the number of parking places in urban centers and other locations by use of the modular pre-fabricated parking lot which is the subject of the invention. More specifically, the present invention allows for the increase in parking spots in already existing parking lots in urban centers an in other vacant lots.

According to the present invention temporary use may be made of a vacant plot of land in the center of town on which it is not worthwhile to construct a permanent parking lot because the owner of the plot is likely to decide at a future date to put the plot of land to a different use.

There are many vacant plots of various sizes in every city, which can be used as parking lots till the owner of the land decides on their final use, or till a formal plan, suitable for that plot of land, is approved on the request of the owner.

According to the present invention it is possible to erect on such plots of land a parking building several stories high, of any desired size, from modular pre-fabricated units, made in a factory and then transported by trucks and assembled with the aid of big cranes and joined to each other into a complete parking structure.

When the plot has to be used for a different purpose the different units can be dissembled and be transported in their entirety to another plot of land to be set up again as a new multi-level parking system.

SUMMARY OF THE INVENTION

According to the present invention there are several types of modular units which can be assembled in diverse variations as in LEGO blocks to yield different kinds of parking lots or to yield different structures to be used for other purposes, as for industry or storage, or for converting sheds into garages etc.

The invention relates to a parking lot, the individual parts comprising it and the method for combining them. The parking lot is a modular pre-fabricated single or multi-level structure constructed of one or more different types of units which are combined according to the desired size and shape of the structure and which can be dismantled and rebuilt or permanently assembled according to the designated purpose of the structure and/or the land.

The modular pre-fabricated parking lot is composed of parking units which will hereinafter be denoted as A, a path between the parking units which will be denoted as B, from elements involved in the approach to the parking lot (such as ramps and steps) which will hereinafter be denoted as C, and from an element of the foundation to be denoted as D.

A—Parking Spaces:

The types of units which compose the parking spaces A will be denoted T, CP, and L, and they are as follows:

a. Units which will hereinafter be denoted as Type T (Table) are table-like units made of reinforced concrete or any other appropriate rigid material. That is, their form is that of a square surface resting on four columns. Along each column there passes one hollow pipe which protrudes from the upper end of the column. Actually each such table-like unit is a combination of columns, beams, and a ceiling into one unit. These T-type units can be constructed in various ways. For example—a unit to be hereinafter denoted $T_1$, in which on both sides of the surface's width there is a tooth-like recess and optionally, along its length there is a rail beam on one or both sides. Another example is a unit to be hereinafter denoted $T_2$ in which on both sides of the surface's width and on one of the sides of the length there is a recess. Type-T units may be constructed without any recess or with any other modification, such as with projections for support instead of recesses. For example two of the table's columns may be combined into a table with one two or three walls which pass between the columns.

A parking lot comprised only of Type-T units which stand adjacent to one another can be constructed. The space between the "table's" legs is utilized for parking. In a multi-level parking lot one table unit is placed on another such that the bottom of each table leg on the upper level fits into the end of the pipe which protrudes from the column of the table on the lower level. A conic-shaped space at the bottom of each column allows for a good fit and insertion of the opening on the bottom of the table on the upper level into the pipes protruding from the level beneath it.

b. Units to be hereinafter denoted CP are connecting plates of reinforced concrete or any other rigid material. These connecting plates may be constructed in various ways and may optionally contain one or more holes on the width, such that into these holes can be fitted the pipes protruding from the columns in unit T. These holes can be conically shaped, that is—wider at the bottom—so as to make the fit easier. The CP units may also optionally include reoesses along the length or width which serve as lower beams or as a base. The CP units function as a bridge between the table units T in order to provide additional parking space and to aid in the horizontal linkage of the structure.

There are many and varied ways of placing the connecting plates between the table-like units. For example, two CP units may be placed between two pairs of tables to Type $T_1$ and $T_2$ (adjacent to one another) along their length, with each CP leaning on a recess on the width of the table. Similarly, more CP units can be placed between a greater number of tables, with the connecting plates leaning on the length or width of the table on recesses or on projections.

The preferred method of constructing the parking spaces is by placing three tablets to be denoted $CP_1$, $CP_2$ and $CP_3$ between two pairs of tables—$T_1$ and $T_2$. It should be emphasized that each pair of tables is adjacent to each other along the length These three connecting plates are located on one side on the widthwise recess of the $T_1$ $T_2$ pair and on the other—on the widthwise recess of another adjacent $T_1$ $T_2$ pair. The pipes protruding from the columns of the $T_1$ $T_2$ tables pass through holes in the appropriate places on the width of the connecting plates The central connecting plate—$CP_2$—leans partially on table $T_1$ and partially on Table $T_2$ and thus in the center of its width are two holes through which the end of the pipe from table $T_1$ and the end of the pipe of table $T_2$ pass. Thus the connecting plats serves also for the horizontal linkage of the structure's tables.

The horizontal linkage between the type T units (the tables) can be made by a metal plate with holes which are fitted into the pipes protruding from the columns of adjacent tables, or alternatively—by means of said connecting plates.

The vertical connection between the tables which allows for the creation of a structure with more than two levels is made by passing a steel cable along the length of the hollow pipes and tying and suspending it on the top of the upper unit and on the bottom edge which is located in the foundations. Alternatively, a permanent vertical connection may be made by pouring any cement-base material which hardens, such as grout, into the hollow pipes which pass along the length of the table's columns.

c. Units to be denoted below as types L units are optional in the parking lot, and with their aid, additional parking spaces may be added at the edges of the structure. These units, which are also made of reinforced concrete, are composed of a plate which stands on two columns on one of its sides and which has the shape of a table which is missing two legs on one of its widths. This item is placed in the structure so that on one side it stands on the two columns, and on the other—the plate leans on the width side of table T such that the holes on the edge of the plate fit into the ends of the pipes which protrude from the table's columns.

Preferably, the three units to be denoted below $L_1$, $L_2$ and $L_3$ are attached on the structure's edge to the pair of units $T_1$ $T_2$, such that the connection of the plates of the elements $L_1$, $L_2$, and $L_3$ to the pair of tables is done in exactly the same way as the connection of the $CP_1$, $CP_2$, and $CP_3$ units to the tables.

B—The Passage Between the Compartments:

There is only one type of unit which creates the passage between the compartments. These are plates made of reinforced concrete which hereinafter will be denoted bridge plates. These plates connect two sections of parking spaces and are placed as a bridge on the recesses of T and CP units on each side. The space created as a result of the creation of this bridge serves for passage of vehicles into the parking compartment.

C—Units enabling the approach of persons and vehicles to the various levels of the parking lot (step ramps).

The units which create an approach to the parking lot will be hereinafter denoted as R and S.

a. The units to be denoted hereinafter as R are ramps for vehicles to ascend to higher levels in the parking lot. The ramps are constructed of four subunits to be hereinafter denoted as $R_1$, $R_2$, $R_3$ and $R_4$. All are made of reinforced concrete or other rigid materials.

$R_1$ is a sloped unit on which a vehicle ascends part of the way to a higher level. Optionally, on both its sides there is a beam which supports the ramp and which also serves as a railing to prevent vehicles from falling. One side of the unit leans on the ground or on the bottom of the lower unit, and the other—on two columns.

$R_2$ is a sloped unit shaped like a table whose legs on one side are shorter than on the other and on which the vehicle ascends to a higher level. Optionally. on both its sides there is a beam which supports the ramp and which serves also as a railing to prevent vehicles from falling.

$R_3$ is a unit similar to $R_2$, which allows the vehicle's continued ascent to the top level. It is table-shaped, and optionally along its length on the external side there is a beam supporting the ramp and also preventing vehicles from falling.

$R_4$ is a unit which is also table-like in shape and which serves as an area for entry of vehicles to the parking lots.

The ramp may be constructed consecutively or alternatively—non-consecutively, such that the ramp reaches a given level and the vehicle ascends to another ramp which stands on the ramp below it.

The construction of the ramp can be similar to the construction of the parking spaces, except that the $R_2$ unit is a sloped table and $R_4$ is a horizontal table, and $R_1$ and $R_3$ are connecting plates with holes fitting into $R_2$ and $R_4$ units respectively.

b. Units to be hereinafter denoted S are steps made of reinforced concrete or any other rigid material and which connect the various levels for pedestrians.

It should be noted that according to the invention steel railings may be added to prevent falls from the parking level and for decorative purposes. The railings may be added to the T and CP units.

D—Foundations:

Unit D is a foundation unit made of metal, its shape being a hollow cylinder or a cube and on its top end there protrudes a hollow pipe on which the table column rests. This foundation unit is mostly sunken into the concrete poured into the structure's foundations, and its upper part protrudes above the cement. The table's legs stand on such units so that the pipe which protrudes from the upper end of the foundation unit enters the conic opening on the bottom of the table's legs. To this unit is attached the suspended cable so as to attach to the foundations.

The above invention relates to the parking lot itself, the units which compose it and method for its construction. The invention in its entirety, including the method for its construction, will be clarified and exemplified with the aid of FIGS. 1 through 30. These examples and figures are in no way intended to limit the scope of the protection of the present invention.

The parts of the modular units are denoted in the figure by Latin letters in order to distinguish them from one another.

Figure 2:
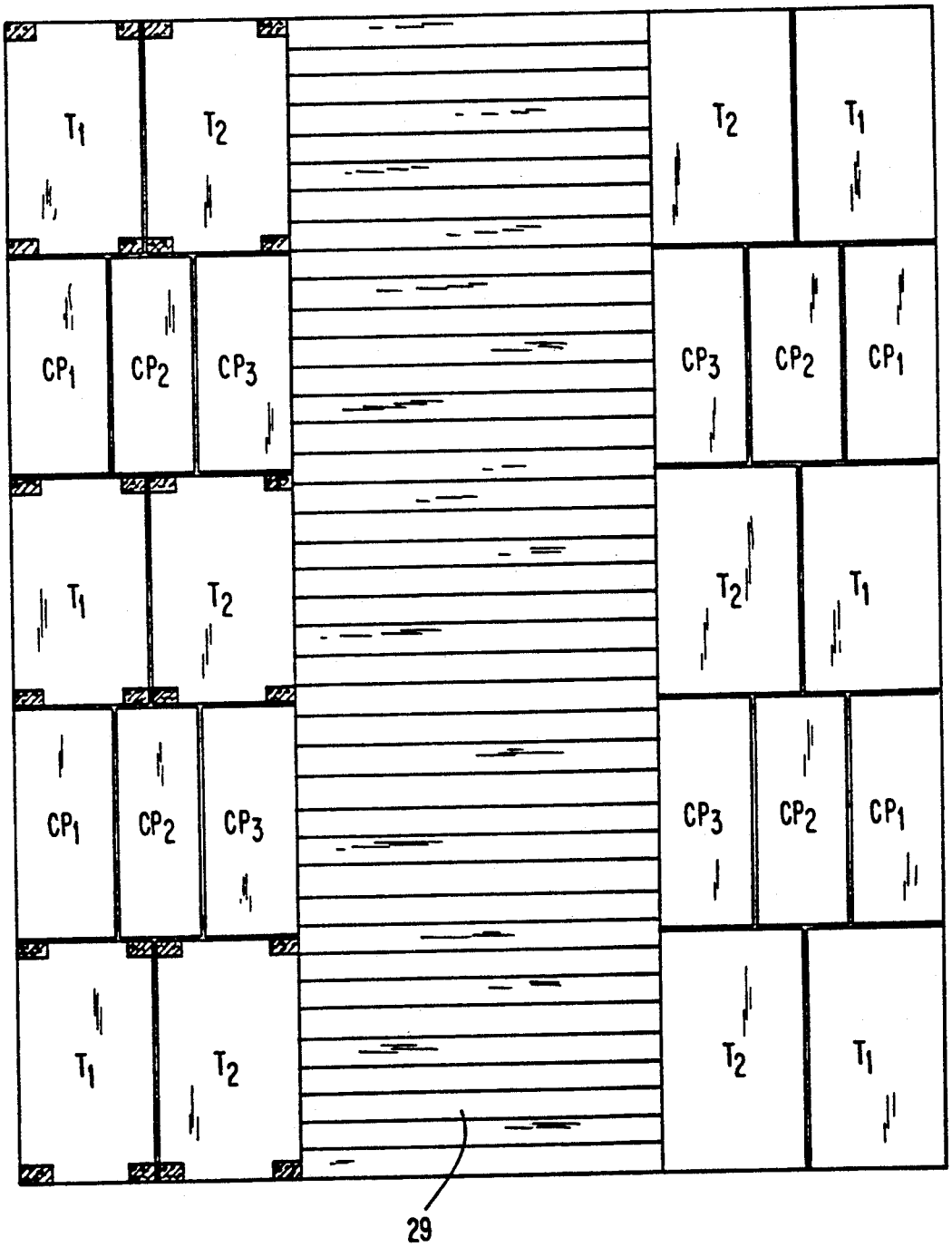

FIG. 2: Describes a general view of the parking lot constructed of an odd number of modular units along its length.

Figure 3:
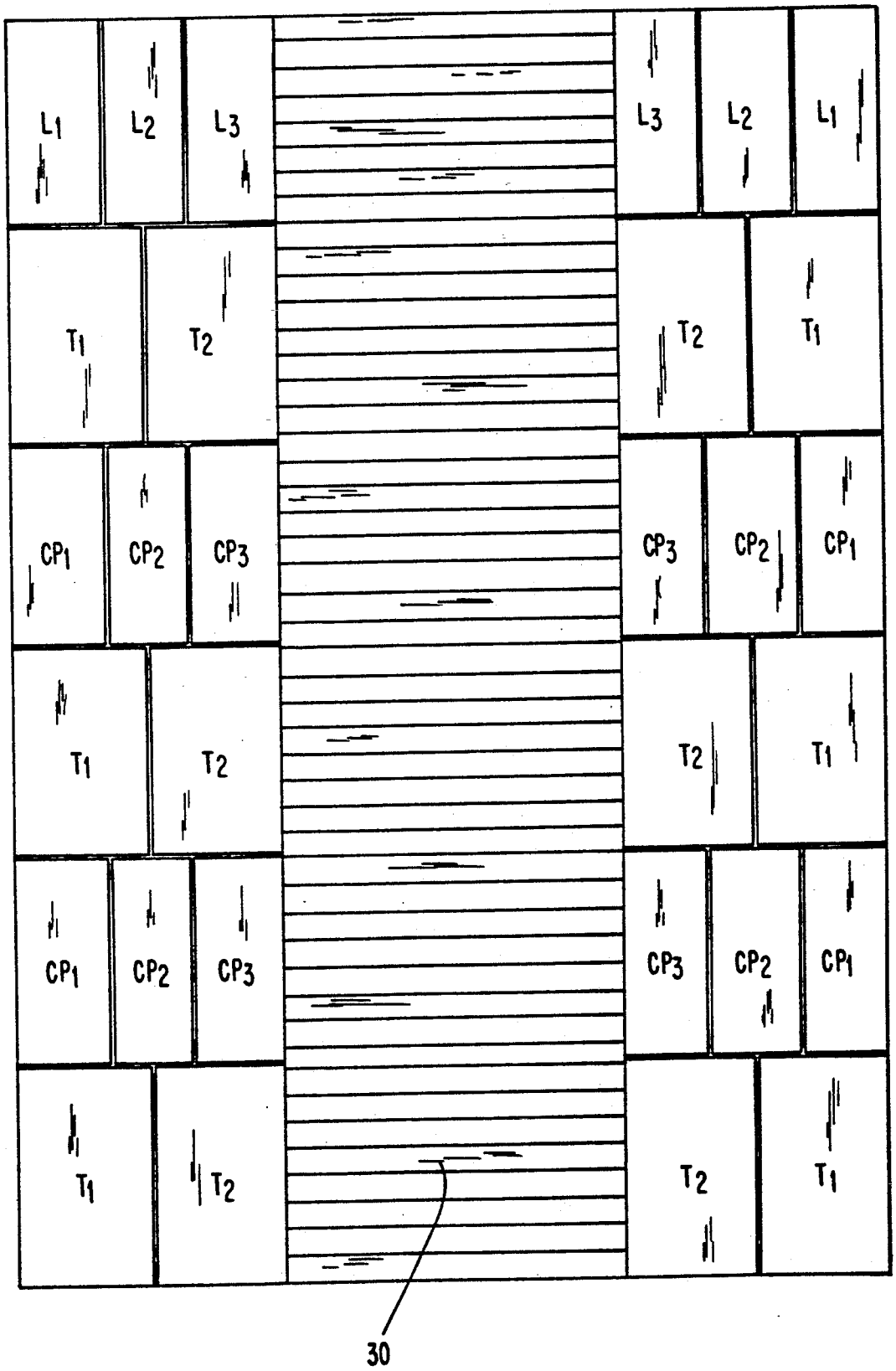

FIG. 3: Describes an example of a view from above of the parking lot constructed of an even number of modular units along its length.

Figure 4:
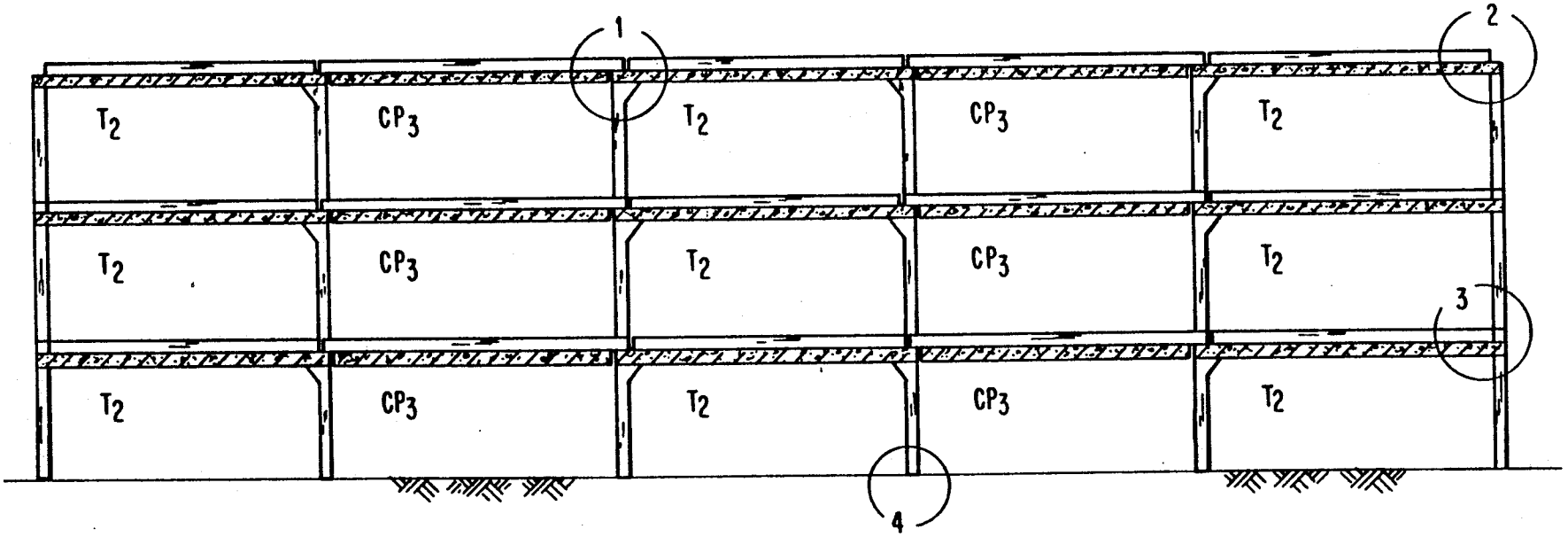

FIG. 4: Describes the internal facade of the parking lot.

Figure 5:
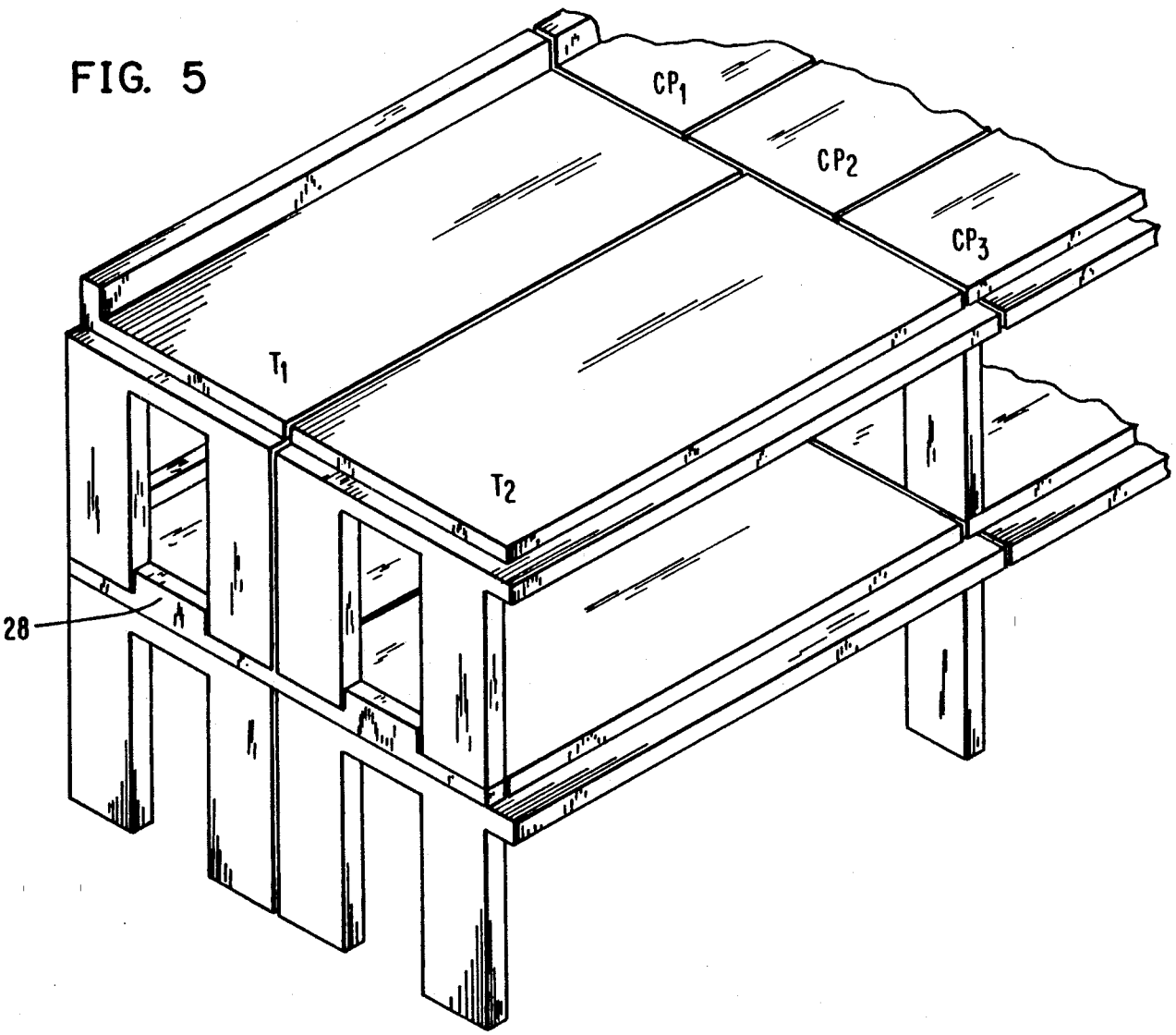

FIG. 5: A partial three-dimensional view.

Figure 6:
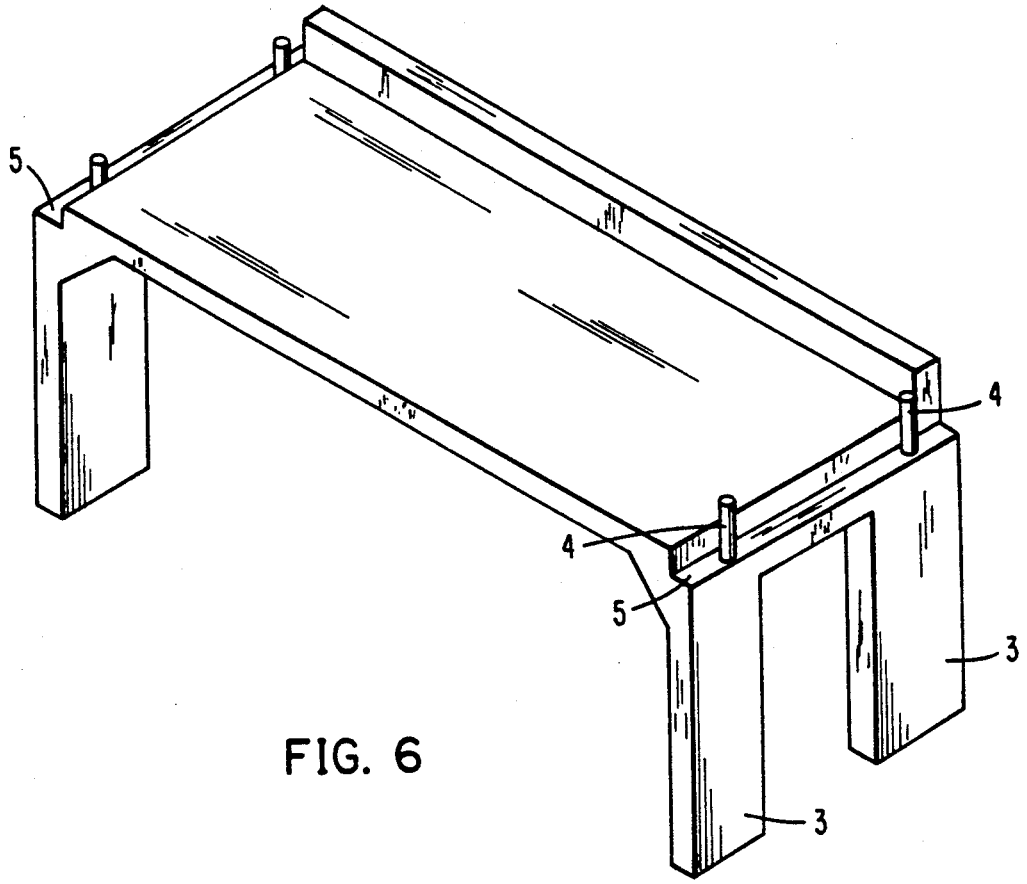

FIG. 6: Describes a modular unit in the system (to be hereinafter denoted as $T_1$).

Figure 7:
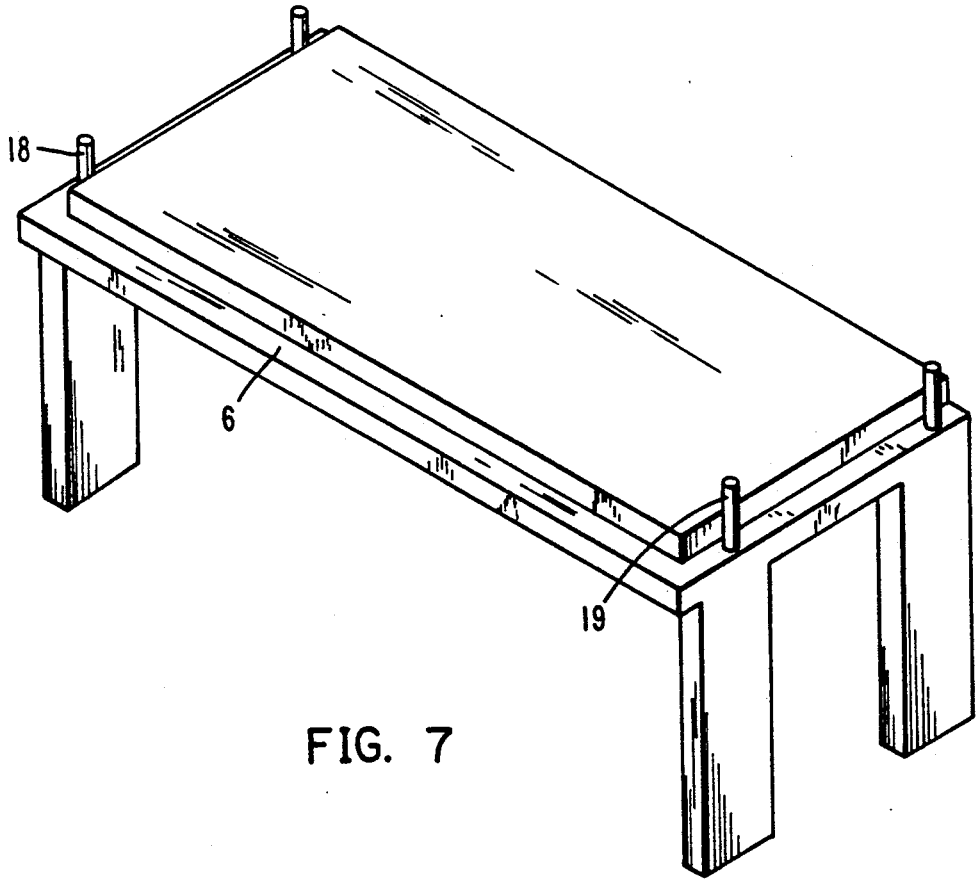

FIG. 7: Describes a modular unit in the system (to be hereinafter denoted as $T_2$).

Figure 8:
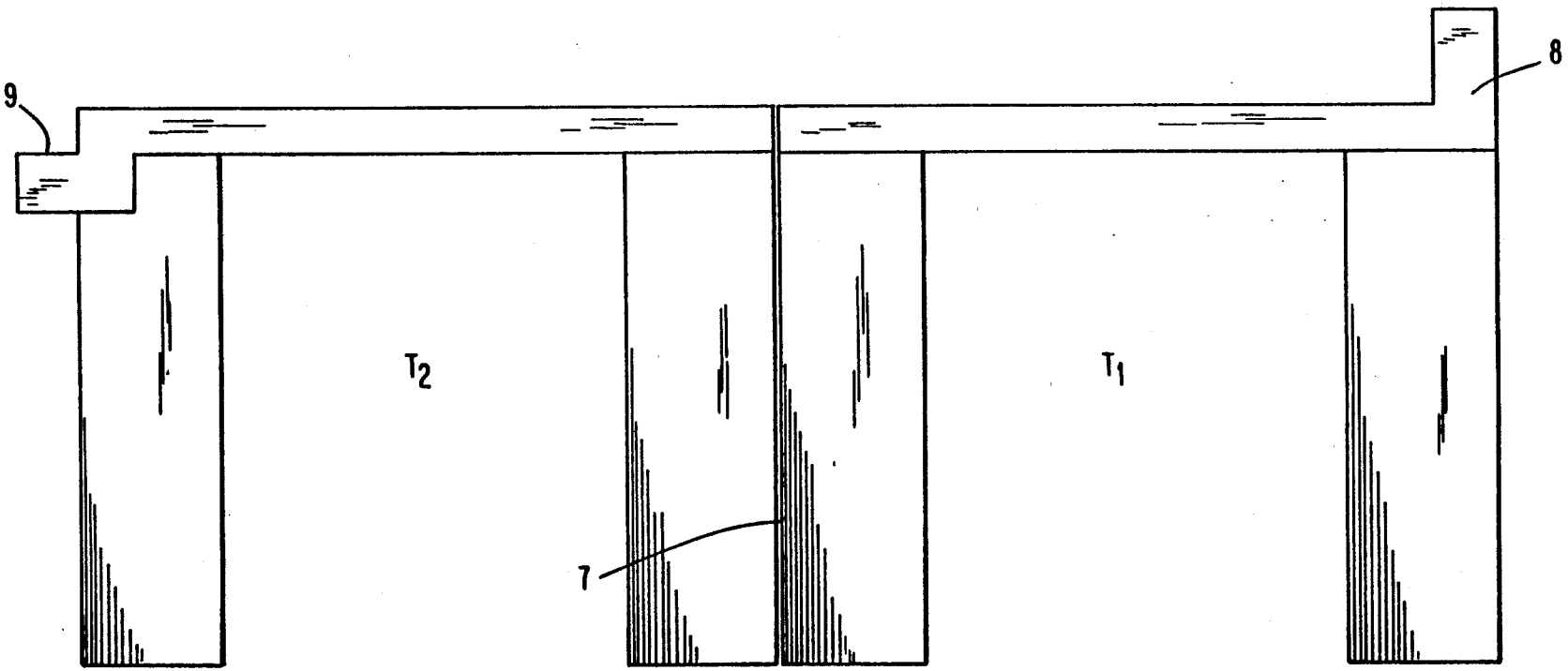

FIG. 8: Describes a side view of Units $T_1$ and $T_2$.

Figure 9:
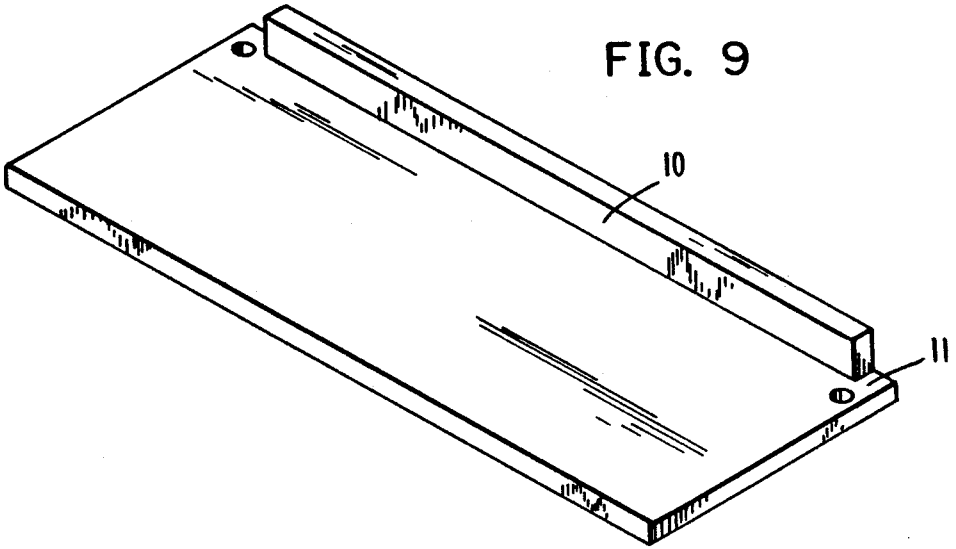

FIG. 9: Describes a modular unit in the system (to be hereinafter denoted as $CP_1$).

Figure 10:
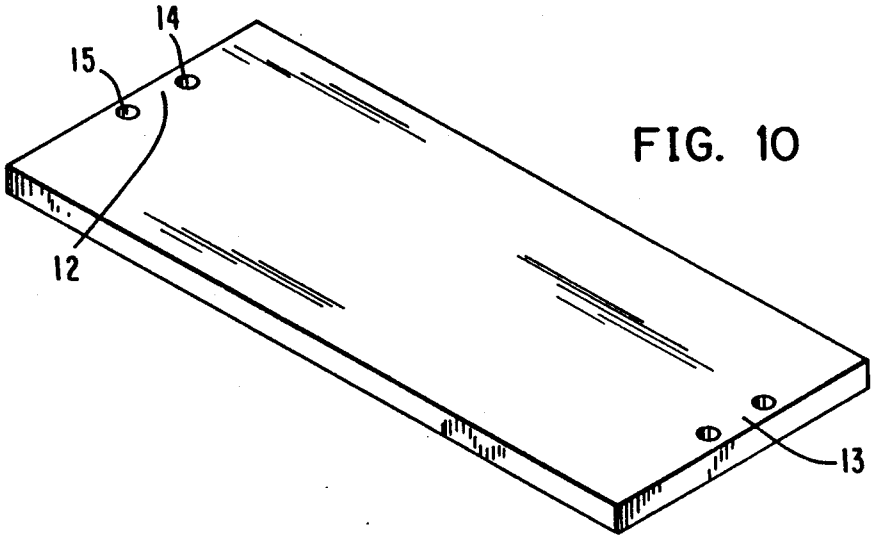

FIG. 10: Describes a modular unit in the system (to be hereinafter denoted as $CP_2$).

Figure 11:
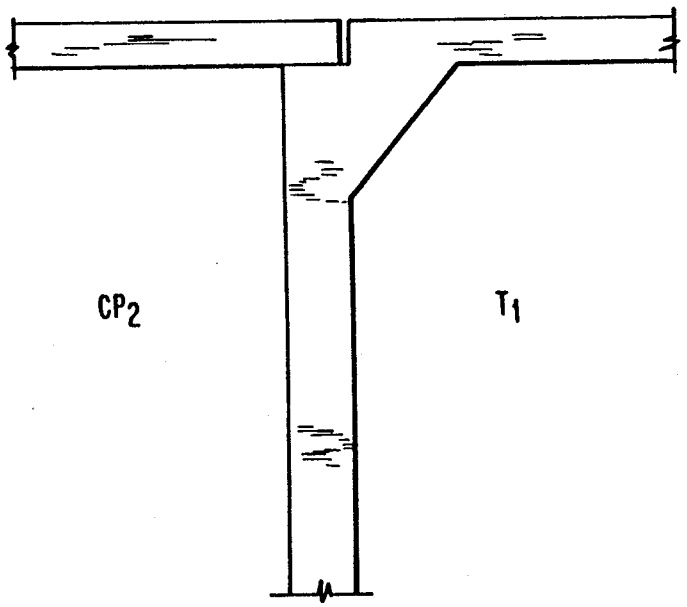

FIG. 11: Describes a side view of unit $CP_2$ resting on a recess of unit $T_1$ in the system.

Figure 12:
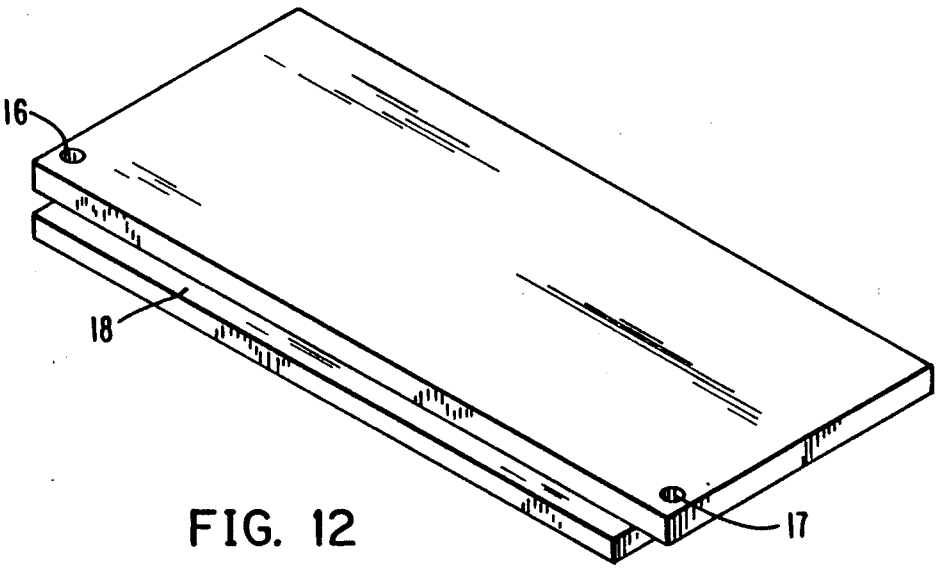

FIG. 12: Describes a modular unit in the system (to be hereinafter denoted as $CP_3$).

Figure 13:
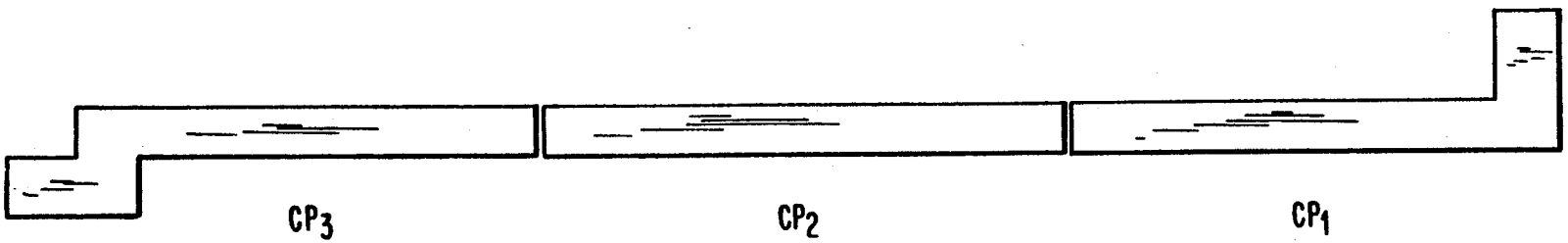

FIG. 13: Describes a lateral-section of units $CP_1$ $CP_2$, and $CP_3$.

FIG. 14: Describes a lateral view of unit $CP_3$ resting on a recess of the $T_2$ in the system.

FIG. 15: Describes a modular unit in the system (to be hereinafter denoted as $L_1$).

FIG. 16: Describes a modular unit in the system (to be hereinafter denoted as $L_2$).

FIG. 17: Describes a modular unit in the system (to be hereinafter denoted as $L_3$).

FIG. 18: Describes a foundation unit (to be hereinafter denoted as D).

Figure 19:
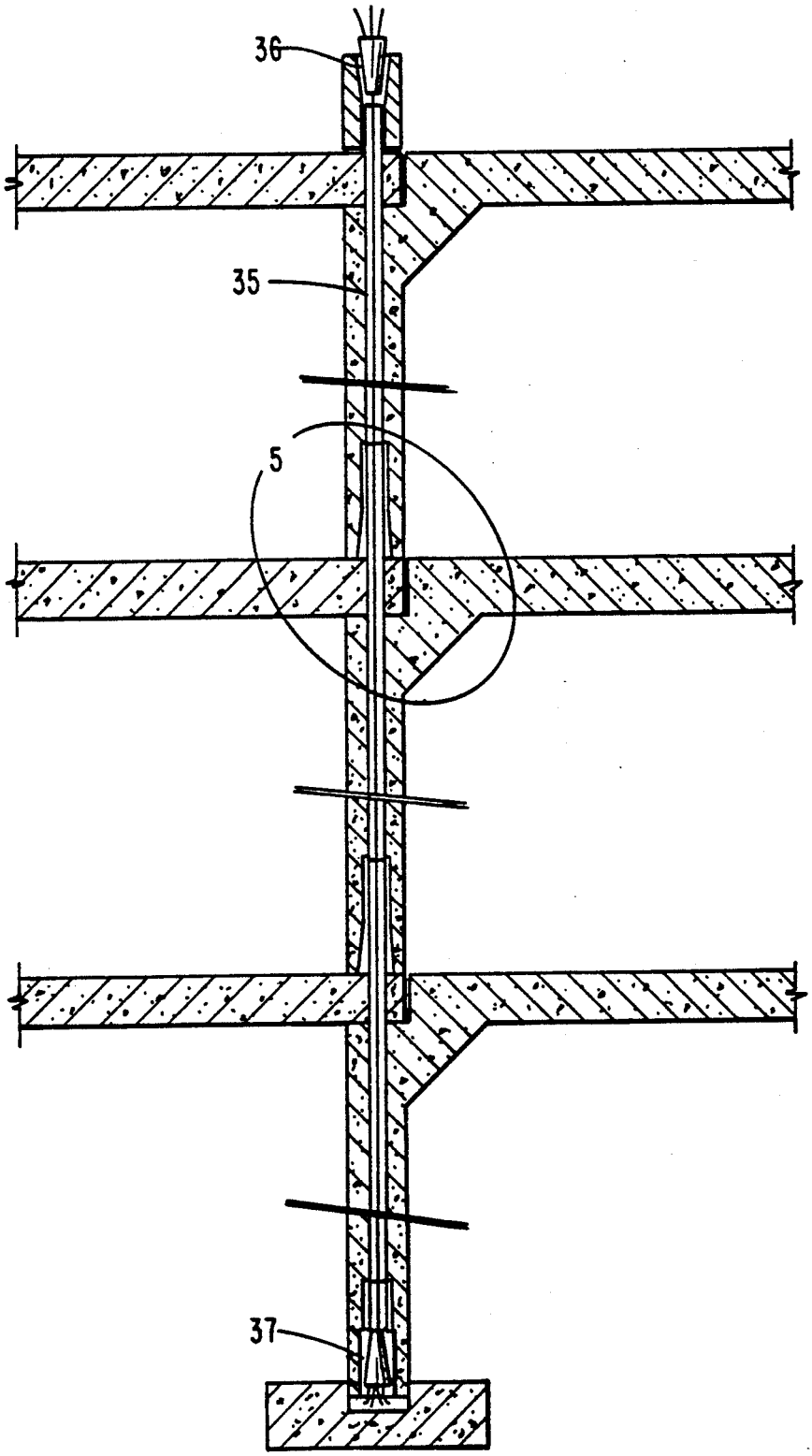

FIG. 19: Describes the vertical attachment of the columns

Figure 20:
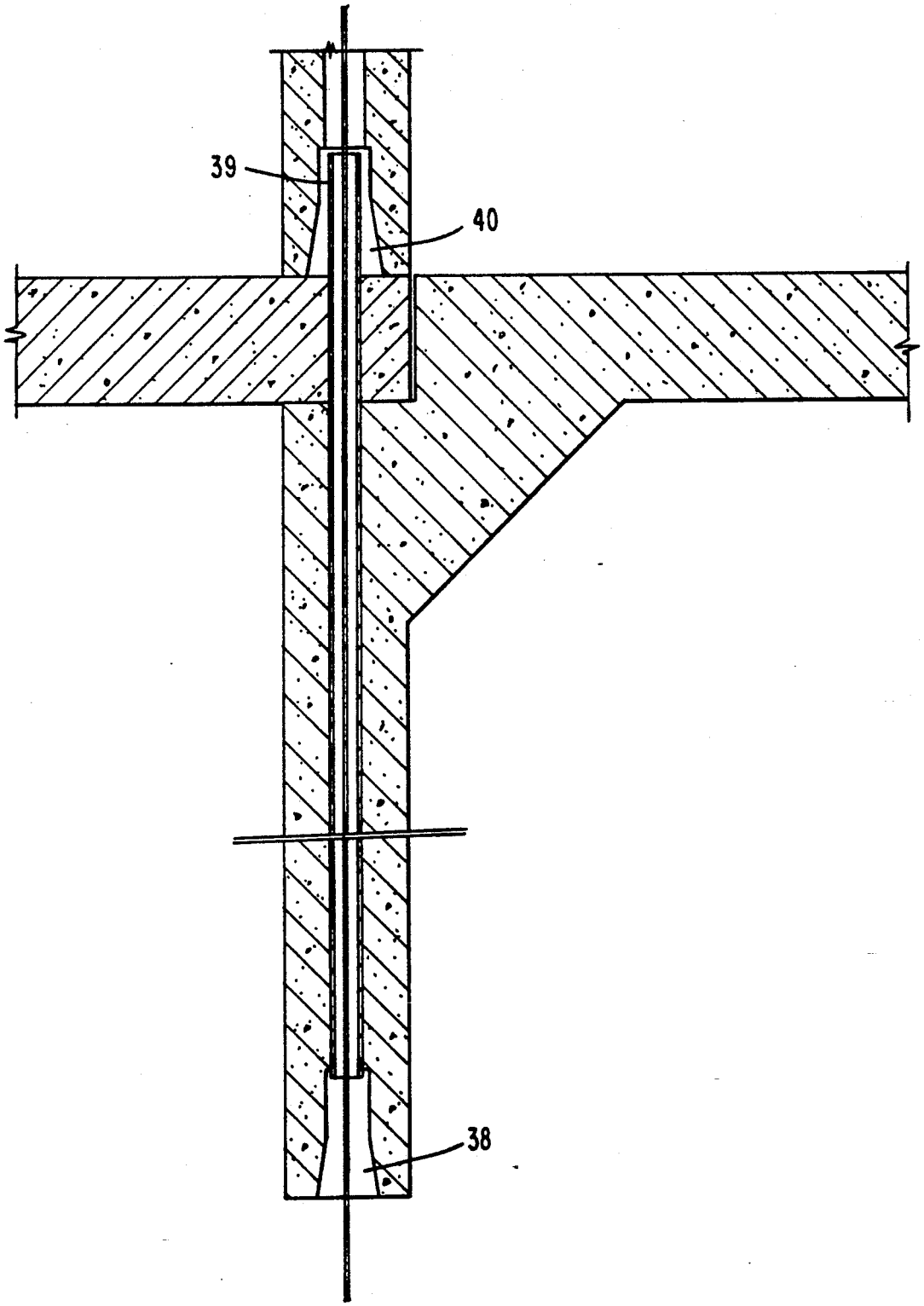

FIG. 20: Describes the vertical combination of units.

Figure 21:
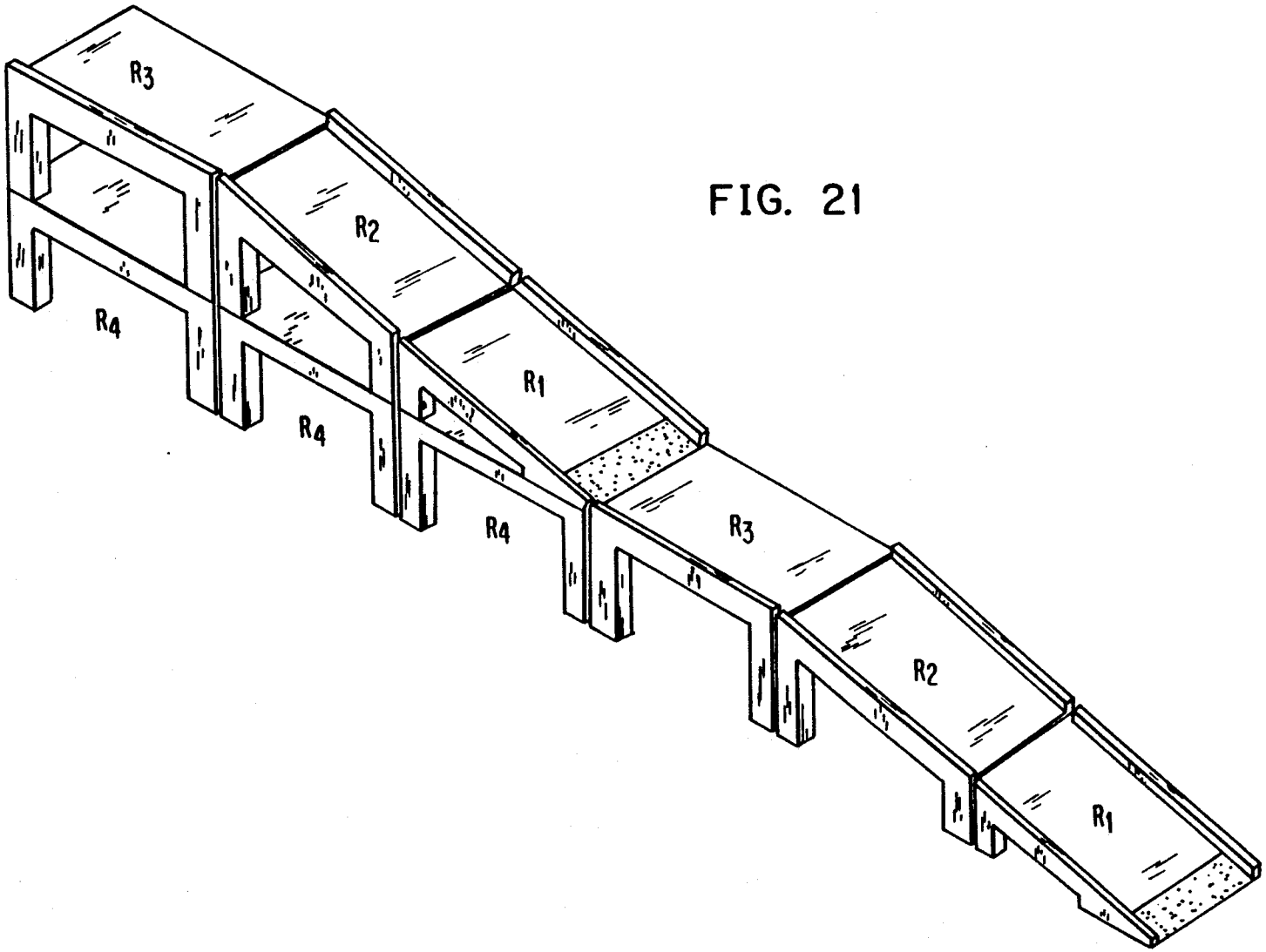

FIG. 21: Describes the ramp for ascending to the parking lot.

Figure 22:
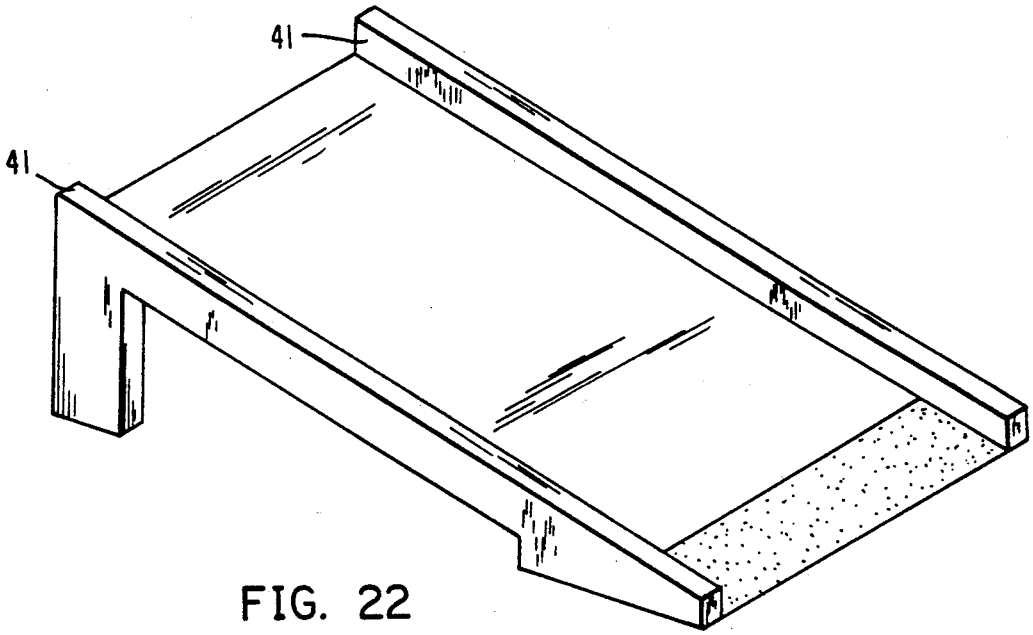

FIG. 22: Describes a modular unit in the ramp (to be hereinafter denoted as $R_1$).

Figure 23:
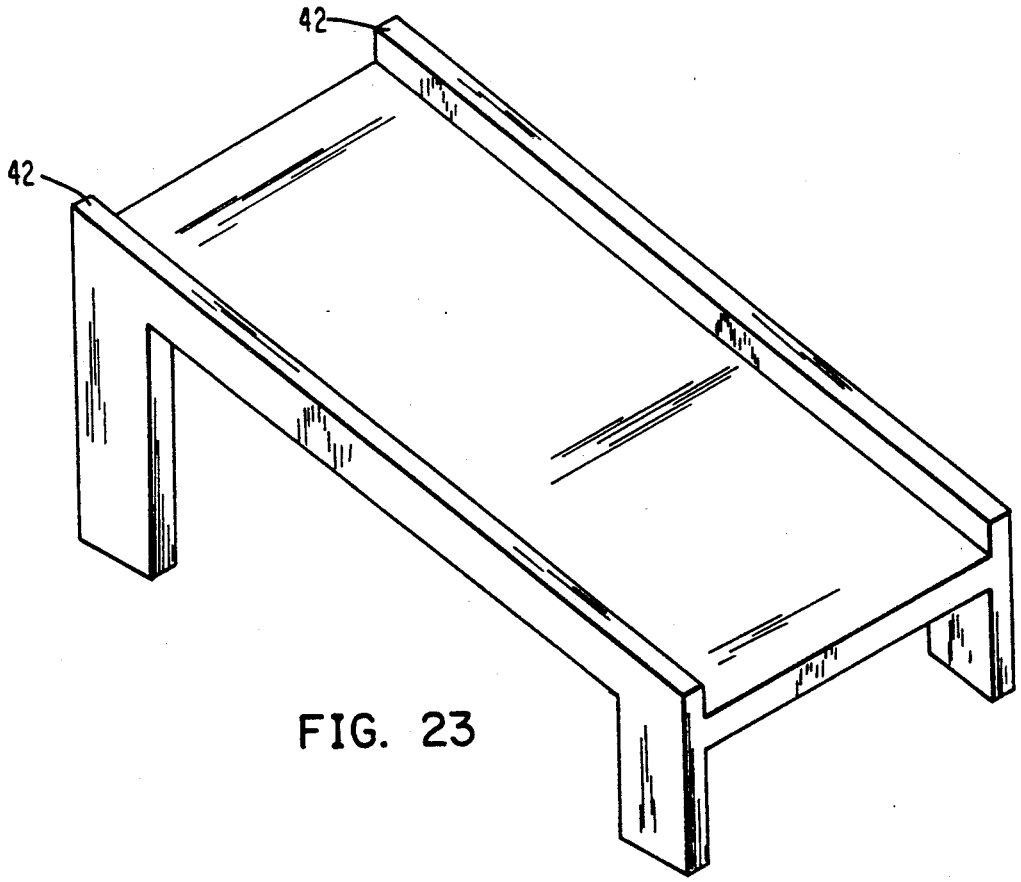

FIG. 23: Describes a modular unit in the ramp (to be hereinafter denoted as $R_2$).

Figure 24:
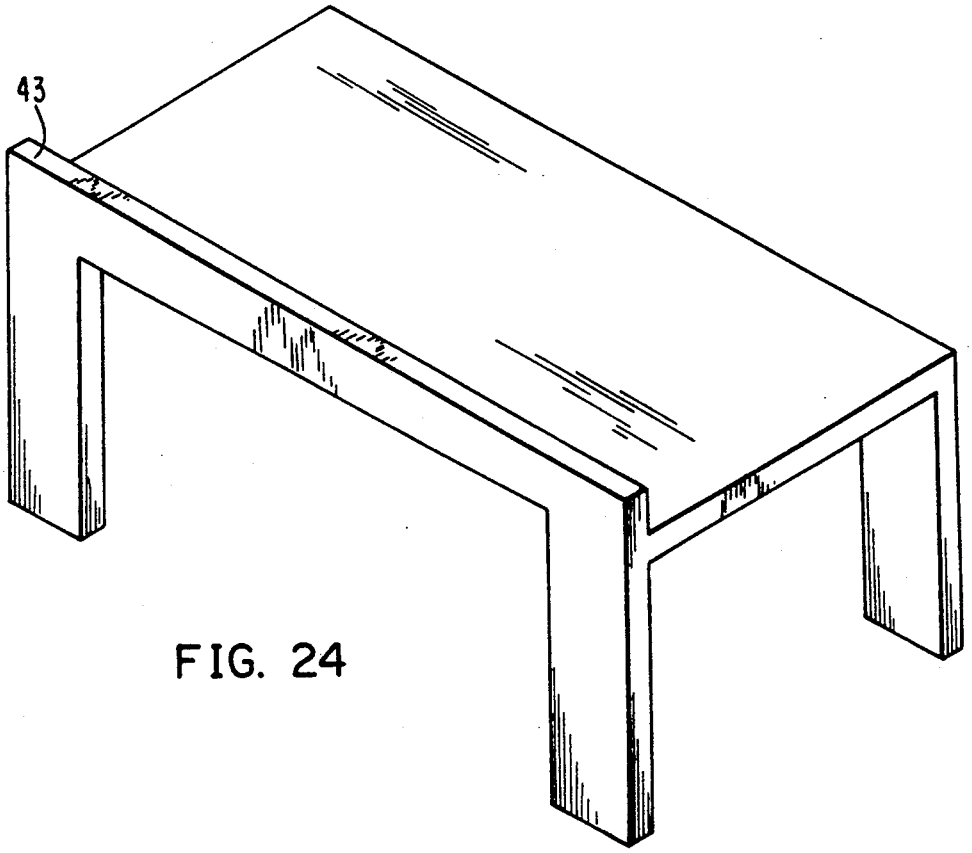

FIG. 24: Describes a modular unit in the ramp (to be hereinafter denoted as $R_3$).

Figure 25:
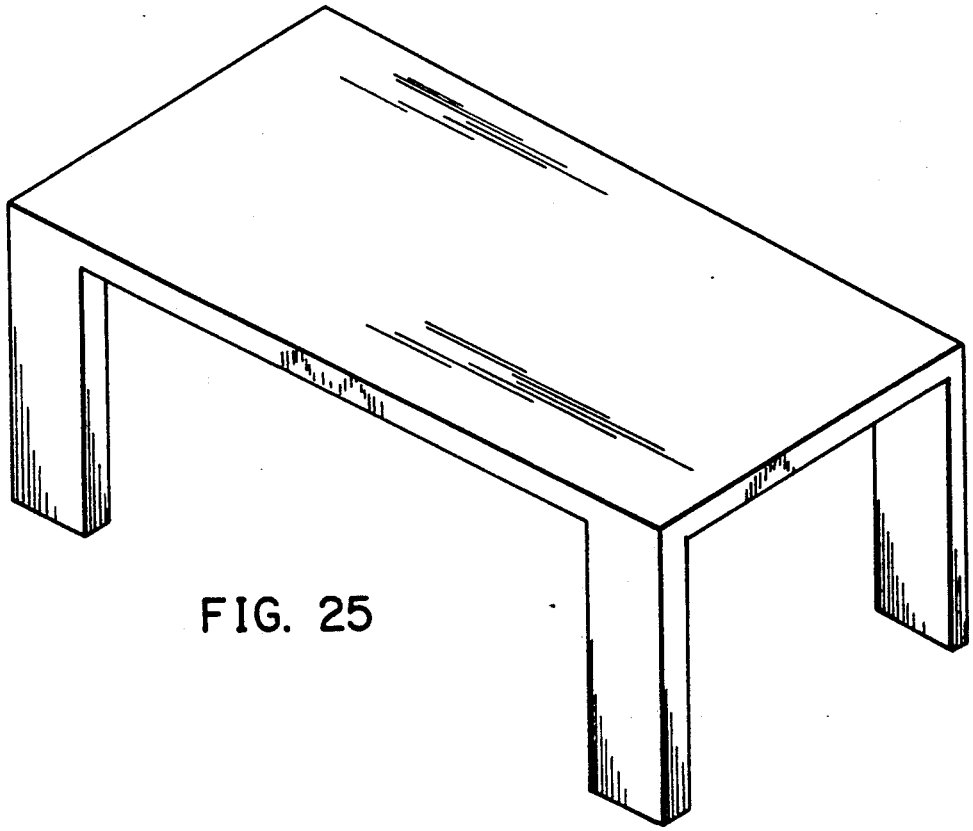

FIG. 25: Describes a modular unit in the ramp (to be hereinarter denoted as $R_4$).

FIGG. 26A and 26B: Describes modular units in the system which serve as steps (to be hereinafter denoted $S_1$ and $S_2$).

Figure 27:
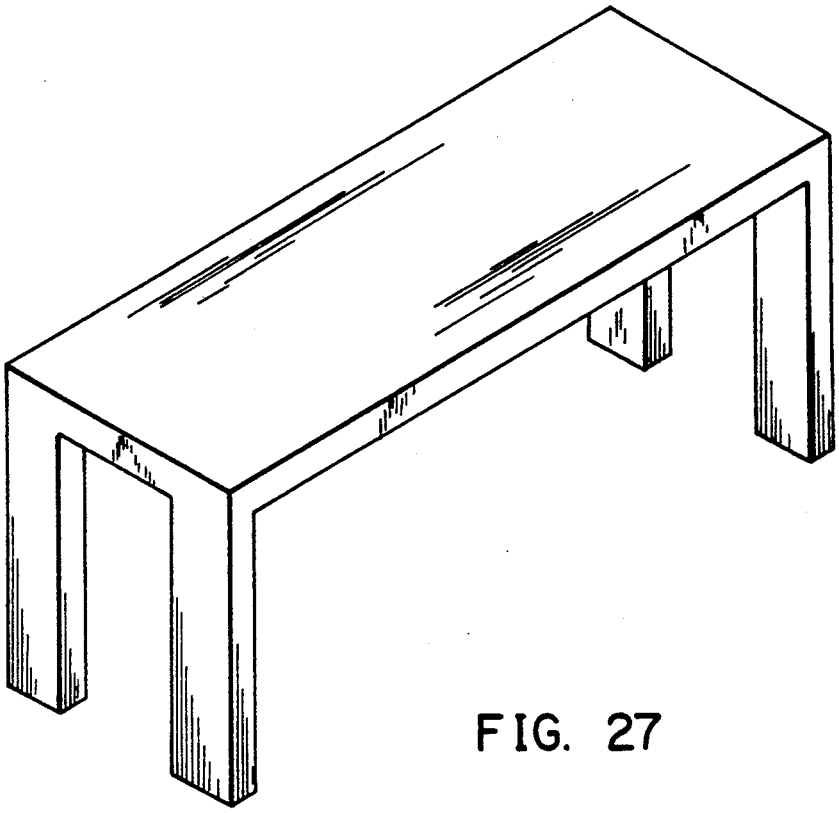

FIG. 27: Describes a modular unit in the system (to be hereinafrer denoted as $S_3$).

Figure 28A:
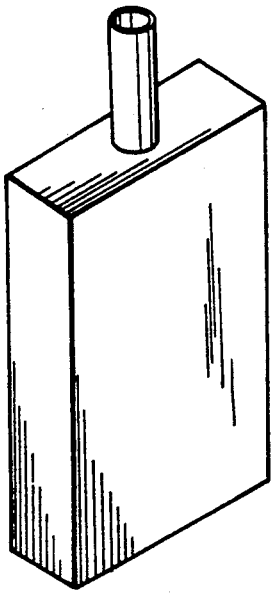
Figure 28B:
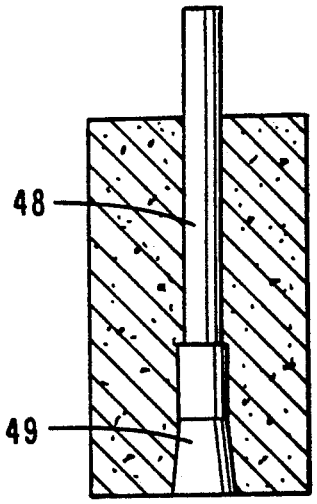

FIGS. 28A and 28B: Describes an extension element for a column.

Figure 29:
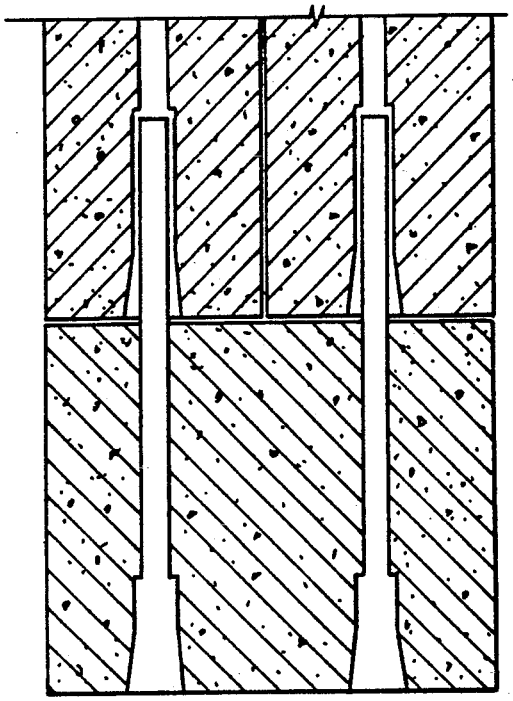

FIG. 29: Describes a cross-section of an extension element for a pair of columns.

FIGS. 30A-30D: Describes typical cross-sections of various columns.

DETAILED DESCRIPTION

Below is a detailed description of the invention with the aid of the attached figures:

FIG. 1:

Describes a general view of an example of a parking lot which can be constructed by combining the modular pre-fabricated units of the system (hereinafter—the "units" or the "items"). A detailed description of the various units comprising the different systems. their structure, and the way in which they are combined with one another will be presented below.

The above figure presents an example of a parking lot with a ramp (1) by means of which the vehicles move from level to level, but according to the present invention parking lots may be constructed with elevators which will take the vehicles up and down between the levels. (For the details of the ramp and its units, see FIGS. 21 to 25). The figure describes three parking levels but, according to the present invention, a parking lot with any number of levels desired can be constructed (subject, of course, to the conditions of the area, the land, and the strength of the materials). Modular units of steps (2) which afford drivers entry and exit from the parking level can be added to the modular system. (Elevators for the service of the public can also be included in the system).

The parking lot as presented in the above figure and in the other figures describing the structure, are of the form of side, roadway, side; that is—a side which contains parking spaces, a roadway in the center, and another side which also contains parking spaces.

In principle, the parking lot can be constructed in a variety of ways. For example—side, roadway or a parking lot of the type—side, roadway, side, in which the difference in height between sides is a half a level so that vehicles can progress in a circular fashion.

It should be emphasized that despite the fact that the main use of this system is as a parking lot, it can be adapted for industry and/or storage or sheds for garages.

FIG. 2:

Describes a general view of a level including an odd number of units along its length. Every type of unit is denoted by a different Latin letter. The structure of each unit and the manner in which it is attached to the adjacent unit on the parking level which includes an odd number of units along its length differs from that which includes an even number of units.

FIG. 3:

Describes a general view of a level which includes an even number of units along its length The structure is characterized by the addition of units $L_1$, $L_2$, and $L_3$ which will be described in detail in FIGS. 15 through 17.

FIG. 4:

Describes the internal facade of the parking lot in a parking lot which is comprised of an odd number of units along its length. (In a parking lot comprised of an even number of units an $L_3$ unit should be added at the edge).

FIG. 5:

Provides a perspective of the parking lot, specifically of type T and CP units.

We shall now describe each unit and the way in which the units are combined, both horizontally and vertically.

All nnits to be hereinafter described are constructed from reinforced concrete but can also be constructed from any other material which is strong and can bear the weight of vehicles, and all are produced modularly and are transported to the area in which the parking lot is constructed by appropriate means of transportation.

FIG. 6:

Describes the modular unit $T_1$ in the system. This unit resembles a four-legged table. Its length, width, and height allow parking of vehicles between its legs while allowing enough space as to conform to all regulations. Along the length of each foot (3) there is a hollow steel pipe which protrudes over the unit (4) as depicted in the figure. On both width sides of the unit's upper part, there is a step (a recess), hereinafter referred to as "the step" (5).

The four pipes come out of the lower part of the step. As will be exemplified below, this step will allow for the attachment of additional units with the help of the pipes.

Along one of the unit's lengths there is a railing to prevent vehicles from falling. The railing can be an integral part of the unit or be a separate part.

It should be emphasized once again that all the figures presented until now and below with regard to this invention constitute only examples and are not in any way intended to limit the scope of the invention. For example, in unit $T_1$ the feet can be round, square, etc. and not necessarily rectangular as exemplified in the figure. It should be noted that each pair of legs on the width of the unit can also be attached by a wall, and thus the wall also serves as one large column.

FIG. 7:

Describes the modular unit $T_2$ in the system. This unit is identical to the unit $T_1$, except for the following differences:

A. The step (6) is also located on one length side in addition to the two width sides. The function of this step is to allow the ends of the concrete plates to lean.

B. There is no railing.

In modular units $T_1$ and $T_2$ as well, each pair of legs on the width of the unit can be combined, and thus the wall created between the legs serves as one large column.

FIG. 8:

Describes a side view of units $T_1$ and $T_2$ as they are placed in the system. The units are adjacent to one another along their length (7) with the railing of unit $T_1$ facing outward on one side (8) and the lengthwise step of unit $T_2$ facing the internal facade on the other (9).

FIG. 5 also presents a clear example of the way in which units $T_1$ and $T_2$ can be placed in the system.

In FIGS. 2 and 3 the location of units $T_1$ and $T_2$ relative to other units in the system can be seen.

Between each pair of units $T_1$ and $T_2$ on each level of the system, $CP_1$, $CP_2$ and $CP_3$ units are placed which—in addition to being parts which add to the parking lot's dimensions—serve also for the connection of $T_1$ and $T_2$ units among themselves and between them and other $T_1$ $T_2$ pairs on the level.

FIG. 9:

Describes a $CP_1$ unit in the system. It is composed of a plate made of reinforced concrete which along its length has a railing (10) as exemplified in the figure. The railing does not reach the end of the plate, but rather leaves a space (11) on each side. On both ends near the railing there are holes of appropriate size so that the pipes which protrude in unit $T_1$ near the railing can pass through them. Unit $CP_1$ is placed between two $T_1$ items and rests on two steps of adjacent $T_1$ items. The width of unit $CP_1$ is smaller than that of unit $T_1$ so that it fits into only part of the widthwise step of unit $T_1$.

FIG. 10:

Describes unit $CP_2$ in the system. This unit is comprised of a plate of reinforced concrete such that in the center of each width at appropriate intervals there is a pair of holes (12) and (13) as illustrated in the figure. Through these holes the appropriate protruding pipes of items $T_1$ and $T_2$ will pass (than the $T_1$ and $T_2$ units will be attached to one another and to unit $CP_2$). In each pair of holes, one (14) through which the pipe of unit $T_1$ will pass and the other (15) through which the protruding pipe of unit $T_2$ will pass, the $CP_2$ unit is placed between two pairs of $T_1$ $T_2$ units, such that half of it is placed on the widthwise step of the $T_1$ unit and the other half - on the widthwise step of the $T_2$ unit, such that the appropriate pair of pipes of pair $T_1$ $T_2$ passes through it on each width.

FIG. 11:

Describes a side view of the way in which unit $CP_2$ rests on the step of unit $T_1$.

FIG. 12:

Describes unit $CP_3$ in the sysLem. This unit is composed of a reinforced concrete plate. On both ends of the length there are two holes (16) (17) and a step (18). Unit $CP_3$ rests on the two widthwise steps of adjacent $T_2$ units, with the pipes—(18) and (19) fitting into the respective holes (16) and (17). The CP unit can also have four holes in four corners.

FIG. 13:

This figure describes a side view of units $CP_1$, $CP_2$, and $CP_3$, such that $CP_1$ is the unit facing outward and on whose end there is a railing and $CP_3$ faces the internal facade and on whose edge there is a recess for placing the concrete plates.

FIG. 14:

Illustrates a side view of how plate $CP_3$ rests on unit $T_2$, and how the recesses on both width sides of the units fit into one another (the recess of the $T_2$ unit with the reverse recess of unit $CP_3$).

A general side view of the way in which the $T_2$ and $CP_3$ elements are attached is found in FIG. 4 (FIG. 13 is an enlargement of the circle which is denoted a number 1 in FIG. 4).

As we saw until now, most of the parking lot is constructed of two pairs of $T_1$ $T_2$ units, such that between them is the trio of units $CP_1$, $CP_2$ and $CP_3$. In this manner a parking lot of any desired size may be constructed with an odd number of elements.

It again should be emphasized that the structure comprising mainly of pairs of $T_1$ $T_2$ units between which are trios of $CP_1$, $CP_2$ and $CP_3$ units as illustrated in the figures is only an illustration. A parking lot can be constructed from a wide variety of other combinations, such as only with type-T tables without connecting plates or with the combination of table-connecting plate-table, with the connecting plate placed parallel to the table. Thus there will be two appropriate tables and two connecting plates or any other combination.

If the constraints of the area require the construction of a system with an even number of elements, three additional units—$L_1$, $L_2$ and $L_3$—must be added to the pair of end units $T_1$ $T_2$. The description of $L_1$ through $L_3$ and the way in which they are attached to the $T_1$ $T_2$ pair will be illustrated by means of FIGS. 15–17.

FIG. 15:

Describes the $L_1$ unit in the system, which is shaped as a long table missing two legs. This unit has two legs only on one width side (20), from which two hollow steel pipes protrude and which pass along their length (21). Along the length of the edge of the "table" plate there is a railing (22), and also on the corner on the side of the railing (as an integral part or seeparately) and opposite the legs—a single hole (23). This unit is placed in the system so that on one side it leans on two legs and on the other—it leans on the recess of the $T_1$ unit such that through the hole in it, there passes the appropriate pipe of the $T_1$ unit. The width of unit $L_1$ is smaller than the width of unit $T_1$ and identical to that of unit $CP_1$.

The two legs in the above unit may be connected such that the unit will stand on a wall instead of on two legs. (With regard to the location of unit $L_1$ in the system, see also the general view in FIG. 3).

FIG. 16:

Describes the modular unit $L_2$ in the system. Its shape also resembles an elongated table with two legs missing. This unit differs from unit $L_1$ in that the $L_2$ unit does not have a railing, and instead of one hole, it has a pair of holes at the center of the width as illustrated in the figure (24) (25). The width of unit $L_2$ is identical to that of unit $CP_2$. This unit is placed in the system such that on one side it leans on two legs and on the other—one half leans on the recess of unit $T_1$ and the other on the recess of unit $T_2$, such that a pipe protruding from unit $T_2$ passes through a second hole (25) (and thus it aids in attaching the $T_1$ $T_2$ units). Along its length the $L_2$ unit is placed like a sandwich between the $L_1$ and $L_3$ units (see also general view in FIG. 3).

In this unit as well the two legs can be attached as described with regard to unit $L_1$.

FIG. 17:

Describes the modular unit $L_3$ in the system. Its shape is also that of an elongated table with two legs missing. It differs from the $L_1$ and $L_2$ units in that along one of its lengths there is a recess (26) which is the beam beariug the concrete plates. In the corner (on the side of the length of the recess) there is a hole (27). This unit, as the two previous ones, can lean on a wall instead of on two legs.

This unit does not have a railing. and as in the $L_1$ and $L_2$ units along its legs there pass two hollow steel pipes which protrude from it. The width of unit $L_3$ is smaller than that of unit $T_2$ to which it is attached and identical to that of unit $CP_3$. This unit is placed in the system so that on one side it leans on its two legs, and on the other—it on the recess of the $T_2$ unit, with the appropriate protruding pipe in the $T_2$ unit (and the one close to the internal facade), fitting through the hole of unit $L_3$. As illustrated the pair of units $T_1$ $T_2$ are connected to one another on a given level and are inseparable inasmuch as they are connected with the three units—$CP_1$, $CP_2$ and $CP_3$.

FIG. 18:

Describes the foundation unit E. This is a metal , cylinder whose bottom is open and whose tope is closed (29). In the lower part there are protruding metal strips (30) whose function it is to anchor this unit more strongly, which is sunken in reinforced concrete which covers most of it up to a level near its upper part (31). From the upper part of the foundation unit there protrudes a hollow pipe (23) which has a cone-shaped opening. The conic opening is anchored to the sides of the unit by means of a metal plate (33).

On the foundation unit there stands a table leg such that the pipe which protrudes on the upper end of the unit enters the conic opening on the bottom of the table leg. When a taut cable is pulled, the cable is tied to the conic opening of the above foundation units and on the conic opening on the upper end of the structure.

FIG. 19:

Illustrates the way in which the columns are attached vertically. As illustrated earlier, there are hollow steel pipes (35) along the length of the columns. Along the length of each pipe there passes a steel taut cable such that on both ends of the column (36) and of the base (27) there is a conus. The cable pulled between the two conii holds the various parts of the column in a stable vertical position.

The circle denoted by number 5 in this figure is detailed in FIG. 20.

We emphasize here and will also illustrate below that more than one pipe can pass through each column.

FIG. 20:

Depicts the path of the taut cable in connecting the elements. On the protruding pipe (39) there fits an additional unit above which there stands a leg of an additional unit on the bottom of which there is also a conic opening (40).

The cable is pulled from the two extreme conii on the top and on the foundations of the structure. The dimensio denoted in this figure are for purposes of illustration only.

By this method. the system ca be dismantled by detaching the taut cable and separating the units from one another, and transferring the system and constructing it on a new site. If desired, the units can be permanently attached to one another by pouring concrete into the vertical pipes which pass along the length of the legs of the units. Additional units in the system which is the subject of the present invention and which should be added, especially with regard to a parking lot are those units required for the construction of a ramp for ascent to the parking lot. The details of the ramp are illustrated in FIGS. 21 through 25.

FIG. 21:

Illustrates a ramp for ascent to the parking lot, to levels two and three. The ramp is constructed of four types units—$R_1$, $R_2$, $R_3$ and $R_4$—all of which are constructed of reinforced concrete or any other rigid material.

FIG. 22:

Describes the unit $R_1$ of the ramp for ascent to the parking lot. On this unit the vehicle ascends the first half of the slope of the incline. On each of its sides there is a beam which holds the ramp and which also serves as a railing to prevent vehicles from falling (41). At the beginning of the incline there is a sloped metal surface attached to the concrete and which allows vehicles to ascend on the unit without colliding into the concrete recess.

FIG. 23:

Describes unit $R_2$ of the ramp for ascent to the parking lot. On this unit the vehicle ascends the second half of the slope of the incline. On each of its sides is a beam which serves also as a railing preventing vehicles from falling (42).

FIG. 24:

Describes the unit $R_3$ of the ramp for ascent to the parking lot. This unit serves as a surface for entrance and departure of vehicles on the edge of the slope of the ramp. Its shape resembles a table and along its length on the exterior there is a beam which bears the ramp and which also serves as a railing for preventing vehicles from falling (43).

FIG. 25:

Describes the unit $R_4$ of the ramp. It is shaped like a table and bears the elements $R_1$, $R_2$, and $R_3$ when ascending to those levels beyond the first.

Figure 26B:
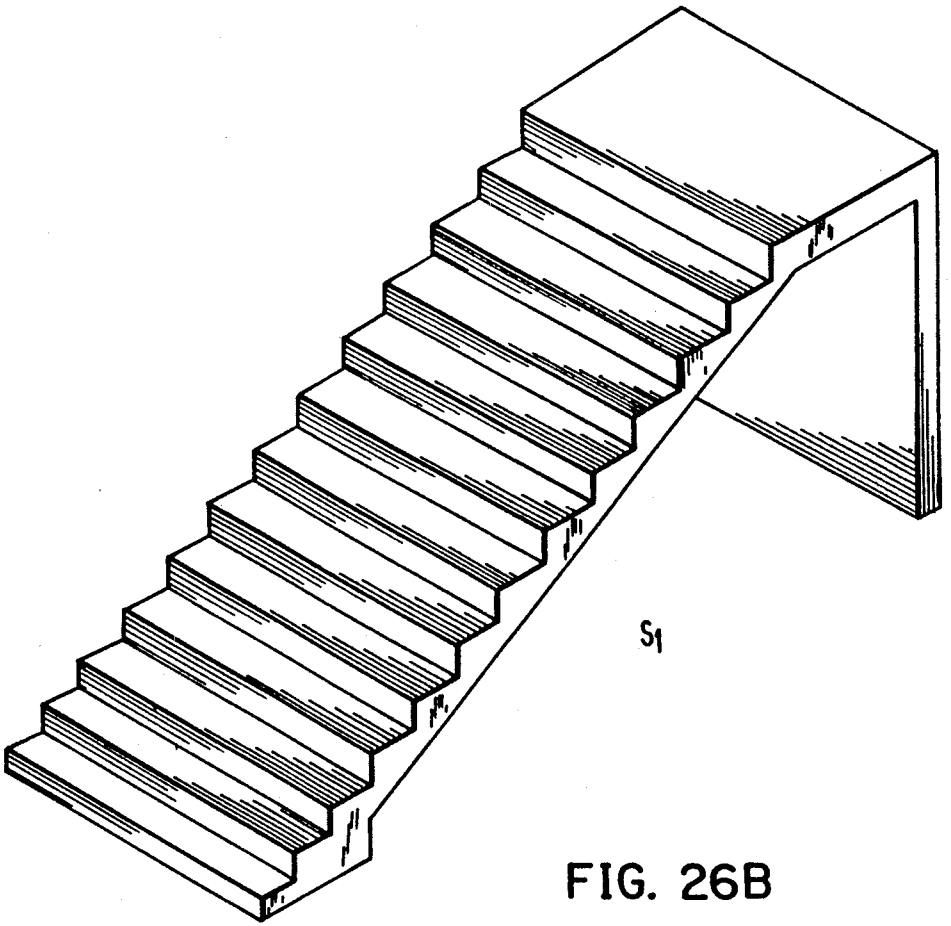
Figure 26A:
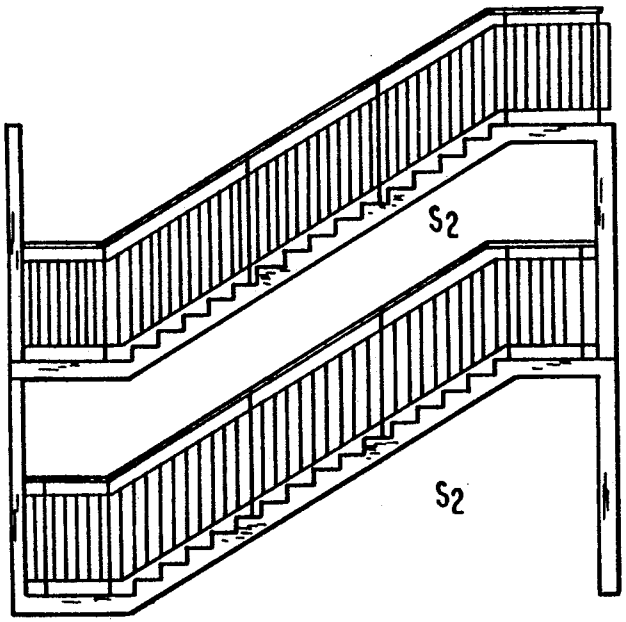

FIGS. 26A and 26B:

Describes the units $S_1$ and $S_2$ in the system. Unit $S_1$ constitutes steps for the passage of pedestrians from level to level. A steel railing can be attached to this item.

Unit $S_2$ in FIG. 26A is a preferred alternative for attaching the stairs in the pre-fabricated system. It is comprised of one unit of poured concrete shaped like stairs, such that on both of its ends there are columns, on its bottom—upwards, and on its upper side—downwards. In these columns, exactly as in the columns of the T tables, there are protruding pipes, and they can fit into any suitable place in the parking lot system, among themselves—as illustrated in FIG. 26A or between them and the tables.

It is possible and desirable to attach to these stairs railing for preventing falls as illustrated in the figure.

Figure 1:
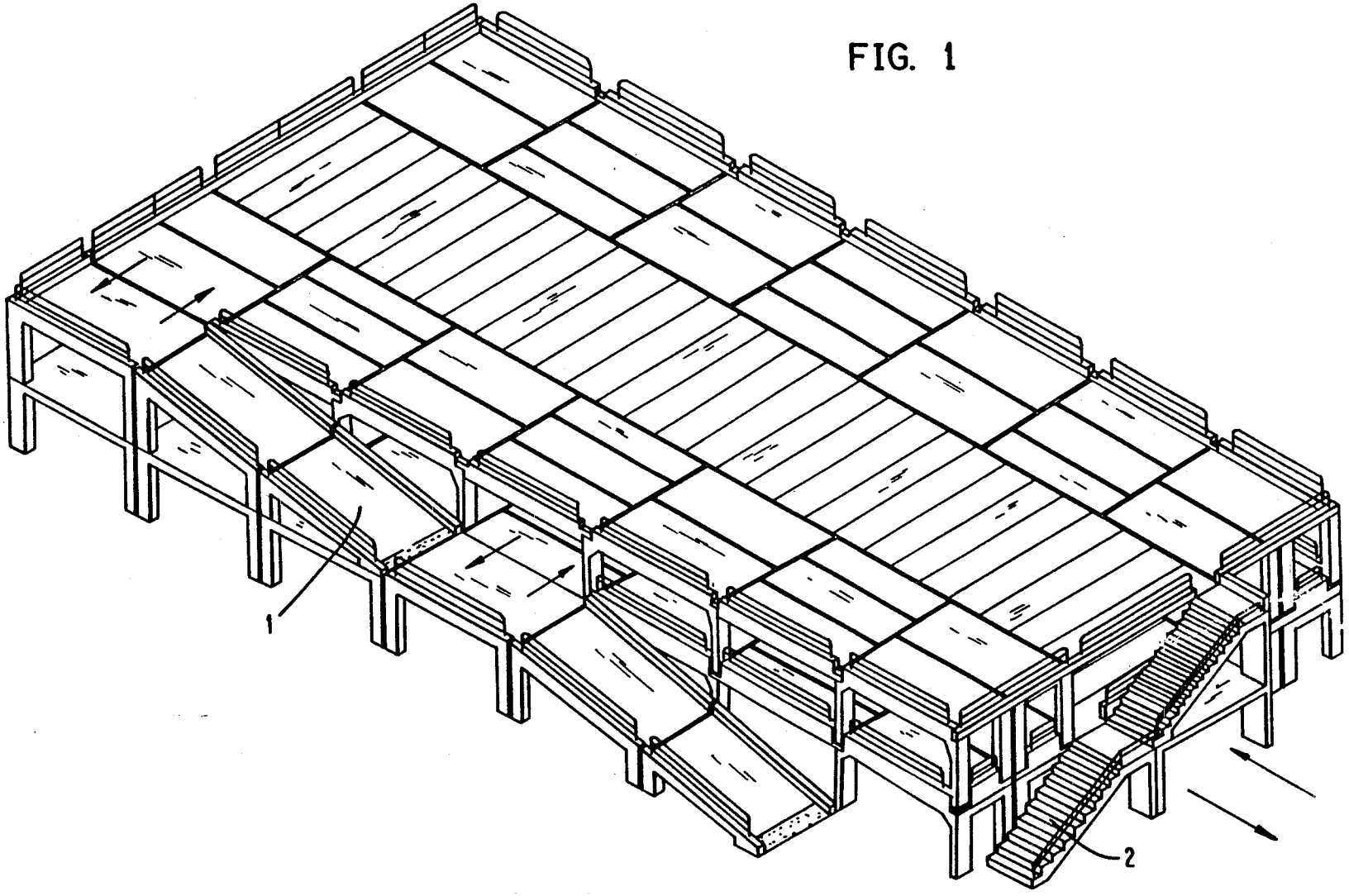
FIG. 1: Describes a general view of the parking lot constructed of a system of pre-fabricated modular units.

FIG. 27:

Describes unit $S_3$ in the system. This unit is shaped like an elongated table and its function is to bear $S_1$ when it is necessary to ascend more than one level. Units $S_1$ and $S_3$ can be viewed when integrated in the system in FIG. 1.

The principle on which the invention is based is similar to that of "LEGO" blocks in children's games. There are several types of units which can be combined or taken apart as needed and varied structures may be constructed. The units are portable and can be transported from place to place. Structures of any desired area, height, and circumference may be constructed. According to the invention the units may be combined temporarily (by a taut cable) or permanently (by putting concrete in the pipes).

In order to increase the possibilities for using the various systems according to the invention. several additional items may be added as described below.

If it is desired to raise the height of all the levels or of a specific level for any reason, for example—if the structure is needed for storage (rather than for parking), extensions may be added to the columns as described in FIGS. 28–29.

FIGS. 28A and 28B

Describes an extension for a column in order to raise the height of the parking compartment. Along the length of the extension there is a steel pipe (48) whose edge protrudes and whose bottom part is cone-shaped (49).

FIG. 29:

Describes a cross-section of he unit which serves to extend a pair of adjacent columns. All the columns which were illustrated in this invention had only one pipe along their length. The scope of the invention is not limited to only one pipe, and according to the invention there may be columns with different numbers of pipes.

FIGS. 30A–30D

Figure 30A:
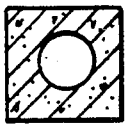
Figure 30D:
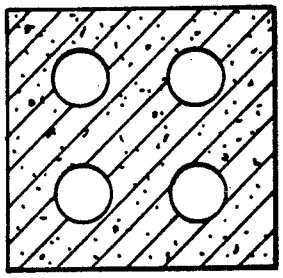
Figure 30B:
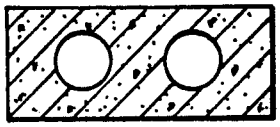
Figure 30C:
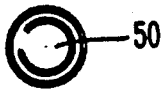

Describes characteristics cross-sections of various types of columns having different numbers of pipes along their length. Also illustrated (50) in FIG. 30C is a connection between a pipe with a closed circumference and one with an open circumference. When the open pipe enters into the closed pipe, one pipe can be fitted into the other with no space between them as a result of some flexibility of the inner open pipe.

The preferred material for construction of the units comprising the system is reinforced concrete. bit in principle they may also be made of any other durable and rigid material or any mixture of materials which is strong, stable and durable as is reinforced concrete.

All the units described heretofore can be also produced without pipes along the length of the columns. The system which is the subject of the invention, when of one or two stories, can stand in a stable way also when the units stand on top of each other or side by side without being attached.

Moreover, according to the invention, the units can be used without any pipes to create a system of any desired size when conventional methods for the combination of prefabricated elements are used, such as tying, screws, welding, soldering, etc. or with pipes without a cable up to two stories.

The units may be used to create a system by using only some of the types of units illustrated according to need, for example—use only of type T units or only T and CP units.

What is claimed is:

1. A multi-level parking lot structure made from pre-fabricated reinforced concrete modular elements which may be combined or dismantled and put together again, said modular elements comprising a plurality of parking compartments; a path means for passage between the compartments; approach route means for entering the parking lot; and foundations; said parking compartments including connecting plates and integral units with four columns, said integral units each including a slab integral with and resting on said four columns and along the length of each column there is at least one pipe which protrudes from an upper surface of the column, wherein the connecting plates are made of reinforced concrete and contain at least one hole, such that into this hole can be fitted said at least one pipe protruding from the columns in the integral units and wherein said path means for passage between the compartments is comprised of plates made of reinforced concrete and placed as a bridge between the parking compartments and wherein said approach route means for entering the parking lot comprises additional connecting plates and modular units creating a ramp for ascent of the vehicles to an upper level, said modular units including modular units with a sloped surface and wherein said foundations constitute a base on which the columns of the integral units on the lower level rest.

2. A structure in accordance with claim 1 such that the units are connected in any known, accepted and conventional manner for connecting pre-fabricated elements.

3. A structure according to claim 1, consisting of two levels.

4. A structure according to claim 3, wherein the units bear themselves on each other and side by side in stable manner by virtue of their weight without need for any linking connection.

5. A structure according to claim 1, comprising more than two levels.

6. A structure according to claim 5, wherein a steel cable or a rod passes along the length of the pipes in the columns and is pulled taut and tied on the top of the structure and at the base such that when the structure is dismantled this cable is first taken out of the pipe and in a permanent attachment of the elements concrete can be poured into the pipes passing through the columns.

7. A structure according to claim 1, wherein the integral unit resembles a table.

8. A structure according to claim 1, wherein said integral unit comprises beams, located under the slab for bearing the connecting plates and the bridge plates.

9. A structure according to claim 1, wherein said pipe is a steel pipe.

* * * * *